US010676303B2

(12) United States Patent
Prankl et al.

(10) Patent No.: US 10,676,303 B2
(45) Date of Patent: Jun. 9, 2020

(54) METHOD AND APPARATUS FOR SUPPLYING, STAGING AND FOR REPLACING ROLLS WITH FLAT MATERIAL AND/OR FILM MATERIAL WOUND THEREONTO

(71) Applicant: KRONES Aktiengesellschaft, Neutraubling (DE)

(72) Inventors: Irmengard Prankl, Rimsting (DE); Herbert Spindler, Niedermoosen (DE); Thomas Wimmer, Rosenheim (DE); Juergen Werner, Bruckmuehl (DE)

(73) Assignee: Krones Aktiengesellschaft, Neutraubling (DE)

( * ) Notice: Subject to any disclaimer, the term of this patent is extended or adjusted under 35 U.S.C. 154(b) by 255 days.

(21) Appl. No.: 15/569,144

(22) PCT Filed: Apr. 14, 2016

(86) PCT No.: PCT/EP2016/058271
§ 371 (c)(1),
(2) Date: Oct. 25, 2017

(87) PCT Pub. No.: WO2016/173860
PCT Pub. Date: Nov. 3, 2016

(65) Prior Publication Data

US 2018/0141772 A1 May 24, 2018

(30) Foreign Application Priority Data

Apr. 30, 2015 (DE) ..... 10 2015 208 102
Apr. 30, 2015 (DE) ..... 20 2015 102 191 U

(51) Int. Cl.
*B65H 19/12* (2006.01)
*B65H 75/24* (2006.01)
*B65B 41/12* (2006.01)

(52) U.S. Cl.
CPC ..... *B65H 19/123* (2013.01); *B65H 19/12* (2013.01); *B65H 75/242* (2013.01); *B65B 41/12* (2013.01);
(Continued)

(58) Field of Classification Search
CPC ..... B65H 19/123; B65H 75/242; B65H 2801/81; B65H 2701/1752;
(Continued)

(56) References Cited

U.S. PATENT DOCUMENTS 3,424,394 A 1/1969 Moore
4,441,662 A 4/1984 Seragnoli
(Continued)

FOREIGN PATENT DOCUMENTS

DE 102010028292 11/2011
DE 202011001929 3/2012
(Continued)

OTHER PUBLICATIONS

German Application No. DE 10 2015 208 102.8 (and Utility Model No. DE 20 2015 102 191.7) Both dated Apr. 30, 2015—German Search Report dated Dec. 9, 2015.
(Continued)

*Primary Examiner* — William A. Rivera
(74) *Attorney, Agent, or Firm* — Simmons Perrine Moyer Bergman PLC

(57) ABSTRACT

Disclosed is a method and an apparatus for supplying, staging, and/or handling, and/or for replacing rolls (12, 20) with flat material and/or film material wound thereonto and serving as packaging material (22) for packaging piece goods, bundles, or the like sets of articles. Depleted rolls (20) are removed from at least one installation position (EB1, EB2) of a packaging machine (14), and new rolls (12) are mounted into the particular installation position (EB1,
(Continued)

EB2), with new rolls (12) being staged to the packaging machine (14) in a specified feeder device.
Each of the installation positions (EB1, EB2) of the packaging machine (14) includes at least one rotatable receiving mandrel (70) for the rotatable reception and holding of the rolls (12). The at least one receiving mandrel (70) is shiftable in its axial direction upon removing a depleted roll (20) and/or upon mounting of a new roll (12).

16 Claims, 20 Drawing Sheets

(52) U.S. Cl.
CPC ..... *B65H 2301/41702* (2013.01); *B65H 2301/413243* (2013.01); *B65H 2511/20* (2013.01); *B65H 2511/222* (2013.01); *B65H 2555/31* (2013.01); *B65H 2701/1752* (2013.01); *B65H 2801/81* (2013.01)

(58) Field of Classification Search
CPC ..... B65H 2511/20; B65H 2555/31; B65H 2301/41702; B65H 2301/413243; B65H 19/12; B65H 2511/222; B65B 41/12
See application file for complete search history.

(56) References Cited

U.S. PATENT DOCUMENTS

| | | | | |
|---|---|---|---|---|
| 4,589,811 | A * | 5/1986 | Riccardo | B65H 19/123 193/35 R |
| 4,840,321 | A | 6/1989 | Focke et al. | |
| 4,948,060 | A * | 8/1990 | Kurz | B65H 19/105 242/552 |
| 5,004,174 | A | 4/1991 | Deutschle | |
| 5,031,381 | A | 7/1991 | Focke | |
| 5,219,127 | A | 6/1993 | Boldrini et al. | |
| 5,249,757 | A | 10/1993 | Draghetti et al. | |
| 5,487,638 | A * | 1/1996 | Salsburg | B65H 19/123 414/626 |
| 5,685,685 | A | 11/1997 | Beckmann | |
| 5,699,979 | A | 12/1997 | Spada et al. | |
| 6,294,467 | B1 | 9/2001 | Yokoyama et al. | |
| 6,678,583 | B2 * | 1/2004 | Nasr | B25J 9/046 206/710 |
| 6,718,727 | B2 | 4/2004 | Focke et al. | |
| 6,733,058 | B1 * | 5/2004 | Nakajima | B65H 19/123 242/559.1 |
| 6,978,964 | B2 * | 12/2005 | Beccari | B65H 16/10 242/559 |
| 7,984,603 | B2 | 7/2011 | Freudenberg et al. | |
| 9,573,713 | B2 | 2/2017 | Huber et al. | |
| 9,919,887 | B2 * | 3/2018 | Macura | B65H 16/10 |
| 9,926,160 | B2 * | 3/2018 | Macura | B65H 16/10 |
| 9,969,587 | B2 * | 5/2018 | Macura | B65H 16/04 |
| 10,016,314 | B2 * | 7/2018 | Eckstein | A61F 13/15764 |
| 2001/0045490 | A1 | 11/2001 | Kiprowski | |
| 2010/0047050 | A1 * | 2/2010 | Barsacchi | B25J 15/0616 414/684 |
| 2016/0060059 | A1 * | 3/2016 | Macura | B65H 16/10 242/555.1 |
| 2016/0060060 | A1 * | 3/2016 | Macura | B65H 16/04 242/558 |

FOREIGN PATENT DOCUMENTS

| | | |
|---|---|---|
| GB | 2145046 | 3/1985 |
| JP | H1045289 A | 2/1998 |

OTHER PUBLICATIONS

PCT Application No. PCT/EP2016/058271 dated Apr. 14, 2016—International Search Report dated Aug. 3, 2016.
PCT/EP2016/058271—PCT Written Opinion of the International Search Authority dated Aug. 3, 2016—English Translation.
Corresponding Chinese Patent Application—First Office Action dated Nov. 1, 2018.

* cited by examiner

METHOD AND APPARATUS FOR SUPPLYING, STAGING AND FOR REPLACING ROLLS WITH FLAT MATERIAL AND/OR FILM MATERIAL WOUND THEREONTO

CLAIM OF PRIORITY

The present application is a national stage application of International Application PCT/EP2016/058271, filed on Apr. 14, 2016, which in turn claims priority to German Application DE 10 2015 208 102.8, filed on Apr. 30, 2015 and German Application DE 20 2015 102 191.7, filed on Apr. 30, 2015, all of which are incorporated by reference.

FIELD OF THE INVENTION

The present invention relates to a method and an apparatus for supplying, staging, and/or handling, and/or for replacing rolls with flat material and/or film material wound thereonto and serving as packaging material for packaging piece goods, bundles, or the like sets of articles.

BACKGROUND OF THE INVENTION

It is common in practice to have a set of articles, such as beverage containers or the like, grouped together in a bundle held together by shrink film in order to prevent the set from shifting or from coming undone during further handling or during transport. From the prior art, bundles are known that comprise four, six, or more containers, for example. Such bundles are very commonly used as sales units for beverage containers or bottles of PET plastic. In order to achieve a high throughput for packaging and/or for subsequent palletizing, it is desirable to assemble such bundles as quickly as possible without interrupting the individual process steps.

In order to provide packaging material or shrink film for wrapping bundles partly or completely, apparatuses and methods are already known that unwind the material from a roll or from a plurality of rolls, convey the material within a packaging machine, and wrap the packaging material around the individual bundles or the particular articles intended to form such bundles. In this context, the unwinding of the packaging material from the roll is usually carried out by machine and, in preferred embodiments, performed in a continuous process. Apparatuses are known in which the packaging material is extracted via rollers from the meanwhile rotating roll. After a roll is depleted and the supply of packaging material is exhausted, that particular roll has to be exchanged or replaced with a new roll.

A method and an apparatus are known, for example, from DE 40 40 545 A1, by which new reels can be supplied and used-up reels can be replaced. This known apparatus has a plurality of stock reels arranged side by side for supplying strip material. The core of the reels is in each case positioned on a common pin. A beginning section of the strip material is previously brought into contact with a roller, which extracts the strip material from the particular reel and guides it in a downward direction away from the apparatus. In order to be able to operate this known apparatus and to unwind the material from the reel, the reel has to be positioned rotation-direction-conformingly with its core on the pin. The strip material or, as the case may be, the first layer of the strip material has to dip down, coming from above, toward the rollers. If the roll were positioned on the pin in counter-rotating direction, the strip material could not, or only with difficulty, be extracted from the reel, which would result in complications for unwinding. According to the direction of rotation of the newly positioned reels, it is necessary in these known apparatuses to manually transpose and rotation-conformingly reposition the reels in order to ensure disruption-free operation.

Apparatuses for the automatic supply of material wound onto rolls, and for the replacement of used-up rolls in processing or packaging machines, are moreover known in various embodiments, for example, as apparatuses for supplying and replacing spools with tape material in a processing machine according to DE 32 02 647 A1 or according to DE 41 42 256 A1.

DE 34 25 734 A1 discloses an automated facility for supplying packaging material to production lines and/or packaging lines. The facility comprises a magazine for the packaging material and a carriage equipped with an articulated arm for taking hold of the packaging material and supplying it to the processing machines located along the processing lines. The carriage with the articulated arm moves along lanes, which can be determined by a computer system that is linked to the processing machines.

A device for providing packaging machines with consumables or with packaging material is furthermore known from EP 1 273 541 B1. The material webs are supplied wound onto reels, which are stacked on pallets, and distributed to a plurality of production and packaging machines, with the pallets first being brought to intermediate stores by pallet conveyors, while individual reels are removed by separate reel conveyors and transported to a machine to be supplied.

DE 10 2006 017 379 A1 discloses a device for handling reels of packaging material. The device comprises a reel storage with a gantry where the reels are provided on pallets. A gantry robot with articulated arm transfers reels as required to reeling systems disposed outside of the gantry. From the reeling systems, the material webs are transported to opposite sides in a direction parallel to the longitudinal extension of the gantry to the machines using the material.

The known handling methods and handling apparatuses generally require accurate positioning and feeding of new reels or rolls with packaging material wound thereonto. If it is not possible to ensure such accurate positioning, the smooth replacement of used-up rolls is jeopardized and the proper functioning of the packaging machine can no longer be ensured.

SUMMARY OF THE INVENTION

An object of the present invention therefore lies in providing an apparatus, a method, and a receiving mandrel for rolls, for handling with a high degree of automation flat material and/or film material that is wound onto rolls. The apparatus and the method are intended to enable a quick and accurate feeding of rolls, they are intended to operate with a high degree of fault tolerance, and they are to ensure smooth replacement of rolls in any operating conditions.

These objectives of the invention are achieved by the subject matter of the independent claims. Features of advantageous developments of the invention are indicated in the dependent claims. For achieving the stated object, the invention proposes a method for supplying, staging, and/or handling, and/or for replacing rolls with flat material and/or film material wound thereonto and serving as packaging material for packaging piece goods, bundles, or the like sets of articles. In the method, rolls, which are at least approximately completely unwound and/or depleted, are removed from at least one installation position of a packaging machine, and in each case a new roll of flat material and/or film material is hereupon mounted into the particular installation position. Thus, an approximately completely unwound and/or depleted roll can have at least one or exactly one winding of flat material and/or film material. It is also possible that the flat material and/or film material is completely unwound from the roll such that merely a roll core remains in an installation position and is removed from the particular installation position.

After each mounting of a new roll, an externally located layer of the particular new roll is normally extracted near or in the area of its free end and, for the purpose of forming an uninterrupted material web, is attached, in particular heat-sealed or glued, to a section of a material web of a further roll being guided in the packaging machine. Other possibilities of attachment are, however, also conceivable in order to ensure the packaging operation. The method provides that new rolls are staged to the packaging machine in a specified feeder device, for example, pallets, shelf systems, AGVs (that is, automated guided vehicles), or the like, and are mounted there into the particular installation position after a used-up roll was previously removed from there, either by at least one gripping device and/or handling device, or possibly also by being directly supplied and taken over by the packaging machine. The rolls can optionally be received from the sorted feeder device and mounted into the packaging machine independently by a suitable gripping device and/or handling device. Likewise, however, variants are also conceivable where the rolls can be transferred directly from the feeder devices into the packaging machine with the help of at least one below-described, axially movable receiving mandrel, without separate gripping devices and/or handling devices being required for this purpose. The at least one installation position of the packaging machine is defined by at least one rotatable receiving mandrel for the rotatable reception and holding of the rolls with flat material and/or film material arranged thereon and to be unwound in the packaging machine.

The method according to the invention provides that the at least one rotatable receiving mandrel can be shifted in its particular axial direction and moved toward the gripping device and/or handling device or, as the case may be, toward the specified feeder device upon the removal of an at least approximately completely unwound and/or depleted roll and/or upon mounting of a new roll.

In this manner, an easy and smooth roll replacement is possible. Since the rolls are normally not held, moved, or handled by being externally gripped, but are rather taken hold of in the most simple way by a receiving mandrel or, as the case may be, by a retaining mandrel, and moved into the packaging machine or, as the case may be, conveyed from a feeder device with new rolls to the machine and/or to a deposit for used-up rolls, with the receiving mandrel or, as the case may be, the retaining mandrel taking hold of the rolls, as the case may be, from the center by being slid into the roll core and being fixed there, easily handleable procedures are required in order to slide the rolls from the retaining mandrel of the gripping device and/or handling device onto the receiving mandrel of the packaging machine and vice versa without intermediate steps. This can be achieved by an axially shiftable retaining mandrel as provided in the method according to the invention.

For taking over a new roll, the at least one receiving mandrel is preferably moved in its particular axial direction by motor, whereby the roll replacement can be easily automated. In this context, the method expediently provides that the at least one receiving mandrel is moved by motor in its particular axial direction in coordination with movements of a gripping device and/or handling device that is designed for mounting new rolls.

In the method, the gripping device and/or handling device can, in particular, be formed by a multi-axis robot that receives new rolls from the specified feeder device and places them in the packaging machine. The gripping device and/or handling device can optionally have a camera or the like optical detection device associated with it, which can be affixed, for example, at a movable cantilever arm that is designed as a component of the gripping device and/or handling device such that the camera or, as the case may be, the optical detection device can detect all movements in the room as well as being able to take hold of the rolls to be received and positioned into the packaging machine.

For being able to receive the rolls, the gripping device and/or handling device or, as the case may be, the multi-axis robot, preferably has suitable gripping elements and/or holding elements. The gripping device and/or handling device or, as the case may be, the multi-axis robot, thus can have, in particular, a retaining mandrel, which dips face-side into the center of the new roll designed as hollow body, the retaining mandrel increasing its maximum cross-sectional diameter or, as the case may be, increasing the surface of its cross section, and hereby clampingly fixing the particular new roll to the gripping device and/or handling device or, as the case may be, to the multi-axis robot.

In the method according to the invention, the gripping device and/or handling device can optionally also be formed by a driverless and/or remote-controlled transport system (AGV, at least one self-driving shuttle) that receives new rolls from the specified feeder device and places them into the packaging machine. This AGV or, as the case may be, the shuttle of the AGV, can have, for example, a gripping arm or the like for receiving and handling the rolls with which gripping arm or the like it receives the roll, deposits it on a transport support surface, whereupon it moves together with the roll to the packaging machine and mounts the roll there. The shuttle can optionally have an own camera associated with it for controlling the shuttle's movements in the room.

The method can in addition provide that, for the purpose of mounting a new roll into the packaging machine, the particular roll is passed on to the receiving mandrel, which has been shifted in its axial direction, and is slid onto it by the specified feeder device and/or by a gripping device and/or handling device associated with said specified feeder device, or, as the case may be, by the handling robot, whereupon the receiving mandrel is returned in axial direction into a position intended for unwinding the roll.

For replacing an at least approximately completely unwound and/or depleted roll, the at least one receiving mandrel can in addition be moved in axial direction and pass on the roll to the gripping device and/or handling device by a stop element, which is movable in a direction parallel to the at least one receiving mandrel, sliding the roll at least partly off of the at least one receiving mandrel and onto a receiving mandrel or retaining mandrel of the gripping device and/or handling device, whereupon the at least one receiving mandrel is returned in axial direction at least so far that the roll is almost completely or completely slipped off.

The method can optionally provide that, for the purpose of mounting a new roll into the packaging machine, the particular roll is directly passed on to the at least one receiving mandrel, which has been axially moved by a sufficient distance, and is slid onto it by the feeder device, for example, by a feed conveyor belt or the like, whereupon the at least one receiving mandrel is preferably axially returned in axial direction into its position intended for unwinding the roll. For replacing an at least approximately completely unwound and/or depleted roll, the at least one receiving mandrel can in addition be moved in axial direction and pass on the roll to a handling device for the disposal of the used-up rolls by a stop element, which is movable in a direction parallel to the at least one receiving mandrel, sliding the roll at least partly off of the at least one receiving mandrel and onto a suitable handling device, for example, a gripping device and/or handling device equipped for that purpose, whereupon the at least one receiving mandrel is returned in axial direction at least so far that the roll is almost completely or completely slipped off.

The method can furthermore provide that at least the positions of the rolls in the area of the specified feeder device and/or in the area of the staging and/or the gripping device and/or handling device and/or its range of movement are detected by suitable optical sensor devices and/or room monitoring devices. Based on the detected room data, movement data, and/or sensor data, it is possible to control at least the movements of the gripping device and/or handling device in the area of the specified feeder device or of the staging for the rolls or, as the case may be, in the area of the particular movement range of the gripping device and/or handling device. In addition, the at least one axially movable receiving mandrel in the packaging machine can be controlled based on the sensor data, in coordination with the movements of the gripping device and/or handling device, in order to thus enable an automated roll replacement.

The mentioned room monitoring devices can be formed, in particular, by at least one optical detection device, in particular, by a camera, which detects at least the movement range of the gripping device and/or handling device and which provides output signals displaying said movement range and the movements of the gripping device and/or handling device taking place therein. In this context, the at least one optical detection device or, as the case may be, the camera can be associated, for example, with the gripping device and/or handling device or, as the case may be, mounted thereat such that the optical detection device or, as the case may be, the camera, is enabled to verify the movements of the gripping device and/or handling device as well as the rotation-direction-conforming orientation of each new roll prior to or, as the case may be, while it is being mounted. The camera can optionally, however, also cover the movement range by being stationarily mounted in the room or to the packaging machine; additional or, as the case may be, a plurality of cameras at the gripping device and/or handling device are possible as well. It is generally possible to use a plurality of cameras or, as the case may be, optical detection devices, of which the output signals overlap and which can be used for the exact localization of all parts, handling systems, and/or rolls with packaging material to be moved.

In the manner described, the method according to the invention enables an exact positioning and feeding of new rolls with packaging material wound thereonto to a packaging machine and the precisely controlled transfer to the at least one receiving mandrel. The accurate positioning of the handling devices can ensure the smooth replacement of the used-up rolls with said new rolls, thus ensuring the functionality of the packaging machine in an ideal manner. The method has a high degree of automation in handling flat material and/or film material wound onto rolls for packaging purposes such that interruption-free staging of flat material and/or film material is possible, if required. The method moreover operates properly and with a high degree of fault tolerance with inaccurately positioned roll feedings; and it can also ensure the smooth roll replacement under all operating conditions.

Furthermore, the method expediently provides that a rotation-direction-conforming position of each roll to be newly mounted into the packaging machine is verified and corrected, if required, that is to say, in the instance of an incorrectly positioned roll with a loose material web end laying in the wrong direction, while the roll is being handled by the gripping device and/or handling device. In order to be able to correct the direction of rotation, the gripping device and/or handling device can have, for example, an intermediate deposit for a roll to be mounted into the packaging machine associated with it, the intermediate deposit serving as support for the roll, in particular, for the roll being deposited, rotation-direction-conformingly staged, and received again by the gripping device and/or handling device for the purpose of being passed on to the packaging machine. The intermediate deposit can be formed, in particular, by a bearing block or the like, which takes up a fixed or variable position within the range of movement of the gripping device and/or handling device. The bearing block itself can optionally be designed as shuttle of an AGV or, as the case may be, of a driverless transport system, whereby it can be enabled, in the instance of a roll to be turned around, to perform a self-acting rotation by 180 degrees about its vertical axis in order to let the gripping system and/or handling system resume in the proper position the roll deposited there. OK Here again, it is possible to provide that a camera is associated with the intermediate deposit or, as the case may be, with the bearing block, thus ensuring an additional optical monitoring at the bearing block in order to detect the positions of the rolls etc. and in order to control the bearing block or, as the case may be, the gripping device and/or handling device in the required manner.

Furthermore, the bearing block can have a rotary drive associated with it for rotating a roll, which is located on the bearing block, about its horizontal central axis in order to adjust the roll's angular position and/or an alignment of an edge of an outer material web layer. Regardless of whether the bearing block is stationary or movable, it can be associated with a turning mechanism suited to it for being able to perform a rotation by 180 degrees with a roll located thereon in order to be able to bring the roll into the correct installation position.

The method can furthermore provide that the packaging machine itself or, as the case may be, its installation positions for the replaceable rolls with packaging material, and also the movements of the axially shiftable receiving mandrels, are optically monitored. In this context, additional optical monitoring devices or, as the case may be, cameras can be provided in the packaging machine, in particular in the area of the rolls to be replaced or, as the case may be, in the area of the at least one installation position.

New rolls can be moved, for example, by a horizontal conveying device into the area of the gripping device and/or handling device and can be directly removed from the horizontal conveying device by the gripping device and/or handling device. Likewise possible is a supply of new rolls on pallets such that, for example, in each case four rolls are disposed standing upright on a pallet, which rolls are brought into the movement range of the gripping device and/or handling device by a suitable supply device in order for the rolls to be received by the gripping device and/or handling device there and to be mounted into the packaging machine, potentially including in the procedure the intermediate deposit, as described above as an option.

In the method according to the invention, it can be furthermore provided that a control unit is coupled with and linked to the gripping device and/or handling device as well as being coupled with and linked to the room monitoring device and that said control unit controls a clocked operation of the horizontal conveying device under consideration of a particular reception of new rolls, the reception having been carried out by the gripping device and/or handling device, from the feeding area and/or from a horizontal conveying device. The control unit can likewise control the repeated reception of new rolls from the delivered pallets.

For achieving the stated object, the invention furthermore proposes an apparatus for supplying, staging, and/or handling, and/or for replacing rolls with flat material and/or film material wound thereonto and serving as packaging material for packaging piece goods, bundles, or the like sets of articles, the apparatus having the features of the independent apparatus claim. The apparatus provides that at least approximately completely unwound and/or depleted rolls are removed from at least one installation position of a packaging machine and can be in each case replaced by new rolls with flat material and/or film material for each particular installation position where, preferably after each mounting of a new roll, an externally located layer of the particular new roll can be extracted near or in the area of its free end and, for the purpose of forming an uninterrupted material web, can be attached, in particular heat-sealed or glued, to a section of a material web of a further roll being guided in the packaging machine.

The apparatus according to the invention comprises devices for staging new rolls for the packaging machine in specified feeder device, such as pallets, shelf systems, AGVs, or the like, as well as optionally comprising a gripping device and/or handling device for taking over the rolls from the specified feeder device and for mounting the new rolls in the particular installation position of the packaging machine and/or for removing used-up rolls from the particular installation positions of the packaging machine. Variants are likewise possible, where the new rolls are directly conveyed to the packaging machine by a feeder device, such as a feed belt conveyor, and can there be brought into their particular installation positions in interaction with at least one receiving mandrel that is axially movable out of the packaging machine. In this context, the rolls can, in particular, be received from the sorted feeding and mounted into the packaging machine independently by suitable handling and gripping devices. The sorted feeding can, however, also be designed to reach directly up to the packaging machine and to be suited for feeding the new rolls directly to the installation positions.

According to the invention, the at least one installation position of the apparatus is defined by at least one receiving mandrel for the rotatable reception and holding of the rolls with flat material and/or film material to be unwound in the packaging machine. In addition, the at least one receiving mandrel is shiftable in its particular axial direction and is movable toward the specified feeder device for the purpose of removing an at least approximately completely unwound and/or depleted roll and/or upon mounting of a new roll. The at least one axially movable receiving mandrel of the packaging machine can thus interact in a suitable manner, as required, with the gripping device and/or handling device or, as the case may be, with the feeder device or the feeder belts, in this way enabling automated replacing of used-up rolls with new rolls with flat material or film material for packaging purposes arranged thereon without requiring any further intermediate steps.

According to embodiment variant, the gripping device and/or handling device can replace the rolls significantly easier by the at least one axially movable receiving mandrel, as it does not need to dip so deep into the packaging machine. The same applies for an alternative embodiment variant in which the sorted feeding for new rolls can interact with the at least one axially shiftable receiving mandrel in such a manner that the new rolls can be brought into the packaging machine directly from the feeder device—which can be formed by a feeder belt or by a suitable horizontal conveying device for the rolls, for example—by the at least one axially movable receiving mandrel.

Moreover, the at least one receiving mandrel can have a motor drive for the purpose of being axially shifted associated with it. A shiftable axial stop element can furthermore be associated with the receiving mandrel, the stop element being motor-shiftable together with the at least one receiving mandrel or opposite to its axial direction of movement in parallel to said receiving mandrel. This stop element facilitates, in particular, the process of slipping off used-up rolls while they are being passed on to the gripping device and/or handling device, which gripping device and/or handling device can have, in particular, a retaining mandrel that is in each case aligned, while passing on rolls to the packaging machine, with the particular receiving mandrel of the machine onto which the roll is slid or from which the roll is extracted. The extraction can be significantly facilitated by the axial stop element, as said stop element can be shifted against the receiving mandrel to be retracted.

The gripping device and/or handling device can, in particular, be formed by a multi-axis robot that receives new rolls from the specified feeder device and places them in the packaging machine. The handling robot or, as the case may be, the multi-axis robot can optionally have a camera associated with it, which can be disposed on a movable or, as the case may be, articulated gripping arm or cantilever arm, for detecting all objects having been taken up and the particular surrounding in order to be able to control the multi-axis robot better and more precisely. The gripping device and/or handling device or, as the case may be, the multi-axis robot has suitable gripping device and/or holding device, formed, for example, by a retaining mandrel, which dips face-side into the new roll designed as hollow body, with the retaining mandrel then increasing its maximum cross-sectional diameter and hereby clampingly fixing the particular new roll to the gripping device and/or handling device or, as the case may be, to the multi-axis robot.

The gripping device and/or handling device can be equipped and controlled in such a manner that it introduces a new roll into the packaging machine by sliding said roll onto the axially moved receiving mandrel. The receiving mandrel can subsequently be moved preferably in axial direction into its intended position for unwinding the roll.

For replacing an at least approximately completely unwound and/or depleted roll in the packaging machine, the at least one receiving mandrel can be moved in axial direction to pass on the roll to the gripping device and/or handling device by a stop element, which is movable in a direction parallel to the receiving mandrel, sliding the roll at least partly off of the at least one receiving mandrel and onto a receiving mandrel or, as the case may be, onto a retaining mandrel of the gripping device and/or handling device, whereupon the receiving mandrel is returned in axial direction at least so far that the roll is almost completely or completely slipped off.

The apparatus according to the invention can optionally be equipped with room monitoring devices for the purpose of detecting at least the positions of the rolls in the area of the specified feeder device and/or of the staging and/or the positions and/or movements of the gripping device and/or handling device within a range of movement, and for the purpose of controlling the movements of the gripping device and/or handling device in the area of the specified feeder device and/or of the staging for the rolls based on the room data, movement data, and/or sensor data detected by the room monitoring device.

In a variant of the apparatus, the room monitoring devices can be formed, for example, by at least one optical detection device, in particular, by a camera, which detects at least the movement range of the gripping device and/or handling device, and which provides output signals displaying said movement range and the movements of the gripping device and/or handling device taking place therein and sends them to a control system. The at least one optical detection device or, as the case may be, the camera can be associated immediately, for example, with the gripping device and/or handling device. A camera can be mounted there, for instance; said camera can then verify the movements as well as the rotation-direction-conforming orientation of each new roll prior to or, as the case may be, while it is being mounted. The camera can optionally also be disposed in the room or, as the case may be, a plurality of cameras can be disposed in the room and/or at the robot or, as the case may be, at the gripping device and/or handling device. If there is a camera, or, as the case may be, if there are optical room monitoring systems, the entire roll replacement is controlled based on an evaluation of image signals said camera provides or, as the case may be, said optical room monitoring systems provide, including the axial shift of the receiving mandrels and/or of the axial stop elements associated with said receiving mandrels.

The gripping device and/or handling device can optionally be formed by a driverless and/or remote-controlled transport system (so-called AGV with at least one self-driving shuttle) that receives new rolls from the specified feeder device and places them into the packaging machine. This shuttle or, as the case may be, the AGV can optionally also have a camera associated with it.

Independently of the concrete design of the gripping device and/or handling device, there are preferably suitable auxiliary devices present for verifying a rotation-direction-conforming position of each roll to be newly mounted into the packaging machine and correcting said position, if required, that is to say, in the instance of an incorrectly positioned roll with a loose material web end laying in the wrong direction, while the roll is being handled by the gripping device and/or handling device. The gripping device and/or handling device can thus have, for example, an intermediate deposit for a roll to be mounted into the packaging machine associated with it, which intermediate deposit can serve as support for the roll, in particular, for the roll being deposited, rotation-direction-conformingly staged, and received again by the gripping device and/or handling device for the purpose of being subsequently passed on to the packaging machine. The intermediate deposit that is optionally present in the movement range can be formed, for example, by a bearing block, which can take up a fixed or variable position within the range of movement of the gripping device and/or handling device. It can also be provided that the bearing block itself can form a movable and self-driving shuttle of an AGV. Moreover, a camera can be optionally associated with the bearing block, whereby an additional optical monitoring at the bearing block is enabled. In addition, the bearing block can be equipped with a rotary drive for rotating a roll, which is located on the bearing block, about a horizontal longitudinal axis in order to adjust the roll's angular position and/or an alignment of an edge of an outer material web layer. The bearing block can moreover optionally have a turning mechanism for being able to perform a rotation by 180 degrees with a roll located thereon. This function is already present in a design of the intermediate deposit as a self-driving shuttle.

The apparatus can furthermore provide additional optical monitoring devices or, as the case may be, cameras in the packaging machine, in particular in the area of the rolls to be replaced or, as the case may be, in the area of the at least one installation position.

It can optionally be provided for the apparatus that new rolls can be moved by pallets or, for example, by a horizontal conveying device, into the area of the gripping device and/or handling device and can be directly removed from the pallet or from the horizontal conveying device by the gripping device and/or handling device. Preferably, it is further provided that a control unit is linked to the gripping device and/or handling device as well as to the room monitoring device, and that said control unit controls a clocked operation of the horizontal conveying device or of a pallet feeder device under consideration of a particular reception of new rolls, the reception having been carried out by the gripping device and/or handling device, from the feeding area and/or from a pallet or, as the case may be, from a horizontal conveying device.

The invention moreover relates to a receiving mandrel for rolls with flat material and/or film material wound thereonto and serving as packaging material for the packaging of piece goods, bundles, or the like sets of articles. Features that have already been described above regarding the apparatus or, as the case may be, the method, can likewise be provided with regard to the receiving mandrel and are therefore not redundantly mentioned herein. It is furthermore possible for features regarding the receiving mandrel as described below to be provided as well for the previously described method or, as the case may be, for the previously described apparatus.

The receiving mandrel is designed to be shiftable in its particular axial direction for the purpose of removing an at least approximately completely unwound and/or depleted roll from a packaging machine and/or for the purpose of mounting a new roll into a packaging machine. In preferred embodiments, the receiving mandrel can be adjustable in axial direction for the purpose of aligning and centrally positioning a newly mounted roll in relation to the packaging material to be unwound from the roll. It is moreover conceivable that the axial position is readjustable while the packaging material is being unwound from the roll so as to compensate for winding inaccuracies and/or for position changes of the packaging material during a packaging operation. Also, it is possible that the receiving mandrel is shiftable and/or readjustable in axial longitudinal extension direction by pneumatic, hydraulic, or electromotive drive.

It is for instance conceivable that the receiving mandrel is designed so that it can be telescoped for the purpose of axial shifting or, as the case may be, that the receiving mandrel comprises at least two elements that are shiftable relative to each other in longitudinal direction of the receiving mandrel. Furthermore, it is conceivable that the receiving mandrel comprises at least two elements coupled pivotably movable with each other for the purpose of axial shifting. In this context, an axis of rotation can have an at least approximately horizontal orientation, with the two elements being swivelable relative to each other with horizontal orientation about the axis of rotation. The two elements can in the process assume a stable position where the two elements are aligned with each other or, as the case may be, are aligned oriented to each other.

Also, it is possible that the receiving mandrel is mechanically linked to an actuator by a hollow-shaft drive or, as the case may be, that the receiving mandrel is rotatingly driven by a hollow-shaft drive. In order to enable the axial movement of the receiving mandrel, it is moreover possible that the retaining mandrel is formed from two elements seated on top of each other, which can be moved relative to each other in axial direction.

Summarized below are a few aspects, characteristics, and details of the method according to the invention as well as of the apparatus according to the invention. The invention thus relates to a method for handling flat material and/or film material that is wound onto rolls and that serves as packaging material for the packaging of piece goods, bundles, or the like sets of articles. The flat material and/or film material can in this context be designed as shrink film or as customary plastic film. The rolls can have a core in a geometric form corresponding to a hollow cylinder and at least partly consisting of a cellulosic material. Advantageously, each particular new roll can hereby be positioned on a pin of the packaging machine, the pin corresponding with the core, and the roll can rotatingly revolve on the pin when packaging material is being extracted or, as the case may be, is being removed from the roll. In the course of the method, rolls, which are at least partially unwound and/or depleted, are removed from at least one installation position of a packaging machine, and in each case a new roll of flat material and/or film material is hereupon mounted into the particular installation position, with the replacing of the rolls being facilitated and supported by an axial shifting of the so-called pins or, as the case may be, of the receiving mandrels of the packaging machine. In particularly preferred embodiments, it is possible for at least two installation positions to be provided. Each of the at least two installation positions potentially has its own receiving mandrel or pin, which can be axially moved out of the machine, and on which the new roll is positioned, and on which the particular roll rotates for the purpose of unwinding its particular flat material and/or film material. In particular, the rolls can be clampingly fixed on the pin of their particular installation position. The pin can be rotationally driven and can transmit a torque to the particular roll mounted on it such that the roll is rotatingly moved by its pin to unwind its flat material and/or film material. Each pin can be associated with a drive by which the particular pin is rotated. The drives can be linked to a control unit described in more detail below or, as the case may be, they can be activated to rotate the pins by a control unit described in more detail below. Before removing a roll with at least partially unwound and/or depleted packaging material from its particular installation position, the clamping connection between the pin and the roll can be undone such that the roll is no longer fixedly linked to the pin and can be removed from the pin. The rotating movement of the pin can be interrupted until a new roll has been positioned on the pin or, as the case may be, until it has been mounted in the corresponding installation position. After each mounting of a new roll in its particular installation position, an externally located layer is usually extracted from the particular new roll near or in the area of its free end and, for the purpose of forming an uninterrupted material web, is attached to a section of a material web of a further roll being guided in the packaging machine.

The externally located layer of the particular mounted new roll can be extracted, after the roll has been mounted, by a suitable gripping element, for example, by a gripping device and/or handling device operating with pneumatic suction pressure, in a mechanically clamping manner, and/or by electrostatic adhesion, with the gripping device and/or handling device moving back and forth between the at least two installation positions. The gripping element can thus extract externally located layers of the new rolls alternately from the at least two installation positions. In practice, such embodiments have proved successful in which the gripping element temporarily fixes in place the particular externally located layer of the new roll using negative pressure. Furthermore, a sealing bar can be provided, which is moved downward and in the process heat-seals the externally located layer of the particular new roll to the material web being guided in the packaging machine. The externally located layer in question can be moved into the operating range of the sealing bar by the gripping element. The temperature-controlled sealing bar can thus move the externally located layer of the new roll in question in a clamped manner against the material web being guided in the packaging machine. Such embodiments have proved particularly successful in which the sealing bar is moved vertically up and down for this purpose and in a vertical downward movement heat-seals the particular externally located layer of a new roll to a material web being guided in the packaging machine.

Normally, the flat material and/or film material of the further roll is not yet completely depleted while a new roll is being mounted and while the material web is being attached, such that flat material and/or film material is being unwound for the packaging operation interruption-free from at least one roll of the at least two installation positions that are provided in preferred embodiments. Advantageously, the new roll can accordingly be mounted while flat material and/or film material is still being continuously unwound from the further roll in the packaging machine. Even while an at least approximately completely unwound and/or depleted roll is being removed from the packaging machine, flat material and/or film material can be unwound from a further roll of the packaging machine such that flat material and/or film material is unwound continuously and interruption-free from at least one roll positioned in the packaging machine in conceivable embodiments. In the method described with the present invention, at least approximately unwound and/or depleted rolls can be sensor-detected and replaced with new rolls of flat material and/or film material by the previously described gripping device and/or handling device. Sensor detection can be carried out, for example, with the help of optical detectors or, as the case may be, of an optical detection system that can be disposed in the area of the at least one installation position. The optical detection system or, as the case may be, the optical detector and the gripping device and/or handling device can be linked to the control unit, which also controls the movements of the gripping device and/or handling device or, as the case may be, of the multi-axis robot and also, where appropriate, the movements of the axially shiftable receiving mandrels or, as the case may be, of the rotatable pins.

It is optionally possible for a horizontal conveying device that is designed for the transport of new rolls to be disposed upstream of the gripping device and/or handling device, with the horizontal conveying device extending into an operating range of the gripping device and/or handling device and being activatable in clocked operation by the control unit in consideration of a removal of new rolls by the gripping device and/or handling device. In further embodiments it is conceivable for new rolls to be staged to the gripping device and/or handling device on pallets or the like. It is also possible to place new rolls in a container or the like, which is located in the operating range of the gripping device and/or handling device, and by which new rolls are staged to the gripping device and/or handling device. The new rolls can be placed into the container unsorted or, as the case may be, in random orientation, with the direction of rotation and/or the rotation-direction-conforming orientation being verifiable and/or determinable by the optical detector.

In an alternative embodiment variant of the arrangement according to the invention, the mentioned gripping device and/or handling device or, as the case may be, the optionally present handling robot can even be dispensed with if the rolls are conveyed directly up to the packaging machine by a suitable feeder device and received there and pulled and conveyed into the particular installation positions, if required, by the receiving mandrels that are designed as active roll receivers. If "feeder devices" are referred to in the present context, this is intended to comprise feeder belts, horizontal conveying devices, modular belt conveyors, or the like. The feeder devices can likewise be formed by suitable AGVs (driverless, preferably autonomously or partly autonomously driving transport systems, so-called shuttles), which convey the new rolls directly up to the packaging machine and, if required, there supply the rolls to the receiving mandrels, which in this case function as active roll receivers and take the new rolls from the AGVs and pull them into the particular installation position in the packaging machine. The receiving mandrel or, as the case may be, the at least one receiving mandrel itself can be designed as AGV and thus, as the case may be, also move toward a particular roll to be received. After the receiving mandrel or, as the case may be, the at least one receiving mandrel has received the particular roll, said receiving mandrel or, as the case may be, said at least one receiving mandrel can move back toward the packaging machine together with the received roll.

As mentioned above, the invention relates to a receiving mandrel for rolls with flat material and/or film material wound thereonto and serving as packaging material for piece goods, bundles, or the like sets of articles. The receiving mandrel can define one of a plurality of installation positions for rolls with flat material and/or film material wound thereonto and serving as packaging material for the packaging of piece goods, bundles, or the like sets of articles. For purposes of removing at least approximately completely unwound and/or depleted roll from one of the installation positions and/or for mounting a new roll into one of the installation positions, the rotatable receiving mandrel can be shifted in its particular axial direction and can be at least partly moved from the particular installation position out of a packaging machine and toward the specified feeding device. In addition, the receiving mandrel can be adjustable in axial direction for the purpose of aligning and centrally positioning as accurately as possible a newly mounted roll in relation to the packaging material to be unwound from the roll. The axial shiftability of the receiving mandrels mentioned above in the context of the facilitated mounting of new rolls into the packaging machine can in this way be additionally used for positioning the newly mounted rolls exactly centrally in relation to the material web to be unwound. It is thus not required to slide the roll onto the mandrel by a precisely defined distance, since said mandrel itself can provide for the precision adjustment after the roll has been slid on in an approximately fitting way in order to convey the material web in an accurately fitting alignment into the machine.

The receiving mandrel can optionally also be repeatedly readjusted in its axial position during the ongoing operation of unwinding the packaging material from the roll, in particular in order to compensate for winding inaccuracies and/or for position changes of the packaging material during a packaging operation. This readjustability can be monitored and initiated, for example, by cameras or suitable optical sensor devices. The shiftability or, as the case may be, the readjustability of the receiving mandrel can be brought about, for example, by a pneumatic, hydraulic, or electromotive drive.

Furthermore, it should be mentioned that the receiving mandrel according to the invention can be a component of an apparatus, as described above on the basis of a number of embodiment variants, for supplying, staging, handling, and/or for replacing rolls with flat material and/or film material wound thereonto and serving as packaging material for packaging piece goods, bundles, or the like sets of articles, said apparatus having a number of alike, in each case axially shiftable and precision adjustable receiving mandrels corresponding to the number of installation positions.

BRIEF DESCRIPTION OF THE FIGURES

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged in relation to other elements to facilitate an understanding of the invention.

FIG. 1 moreover illustrates a conceivable implementation of an embodiment for the method according to the invention.

DETAILED DESCRIPTION OF THE INVENTION

Figure 1:
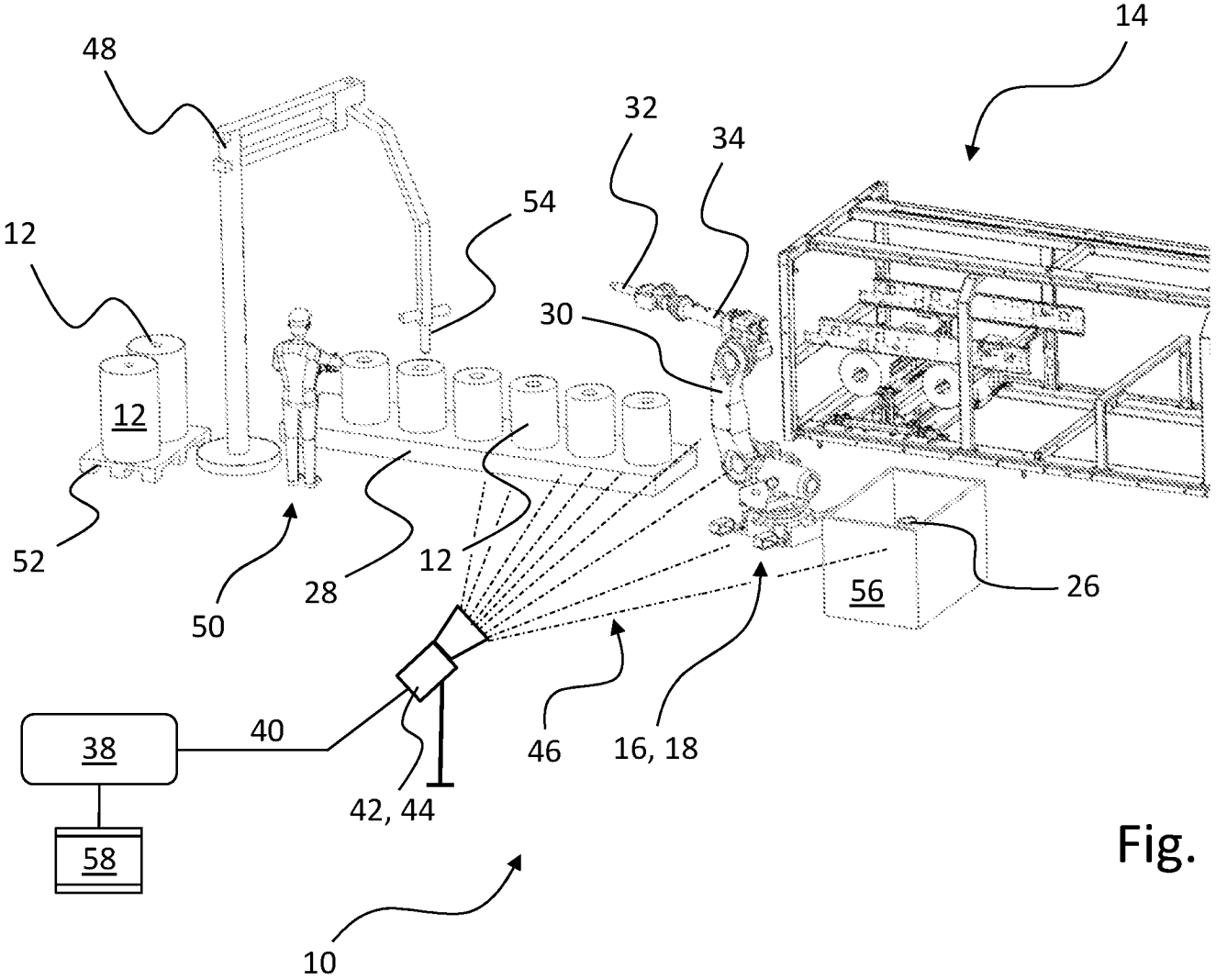
FIG. 1 shows a schematic perspective view of a first embodiment of an apparatus according to the invention.

The same or equivalent elements of the invention are designated by identical reference characters. Furthermore and for the sake of clarity, only the reference characters relevant for describing the individual figures are provided. It should be understood that the detailed description and specific examples of the apparatus as well as of the method according to the invention, while indicating preferred embodiments, are intended for purposes of illustration only and are not intended to limit the scope of the invention.

The schematic perspective view of FIG. 1 shows a first embodiment variant of an apparatus 10 according to the invention. FIG. 1 moreover illustrates a conceivable implementation of an embodiment for the above-described method according to the invention. The apparatus 10 serves for handling planar packaging material, such as shrink film or packaging films wound onto large rolls 12, which due to their weight are usually not manually handleable. Schematically indicated in FIG. 1 is a part of a packaging machine 14, to which new rolls 12 are being fed by a gripping device and/or handling device 16 to be described in more detail below. The gripping device and/or handling device 16, which in the exemplary embodiment shown here is designed as a stationarily disposed multi-axis robot 18, mounts the new rolls 12 that are in each case to be fed to the packaging machine 14 into two different installation positions EB1 and EB2, which are only rudimentarily discernible in FIG. 1 and will be exemplarily illustrated in the detailed view of FIG. 3.

Figure 3:
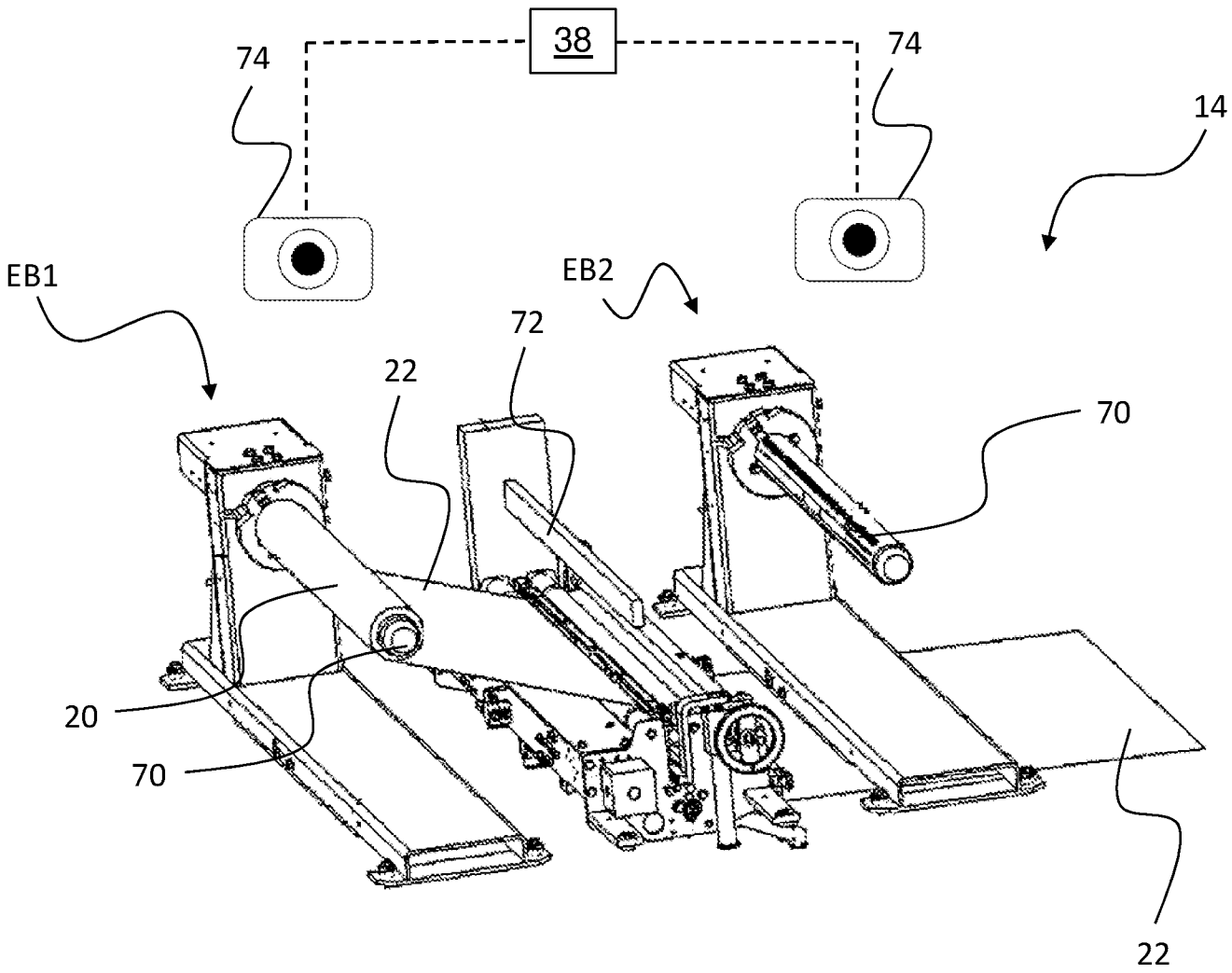
FIG. 3 shows a schematic perspective view of two installation positions for rolls within the packaging machine, which packaging machine can interact with an apparatus according to the exemplary embodiments from the FIGS. 1 and 2.
Figure 4:
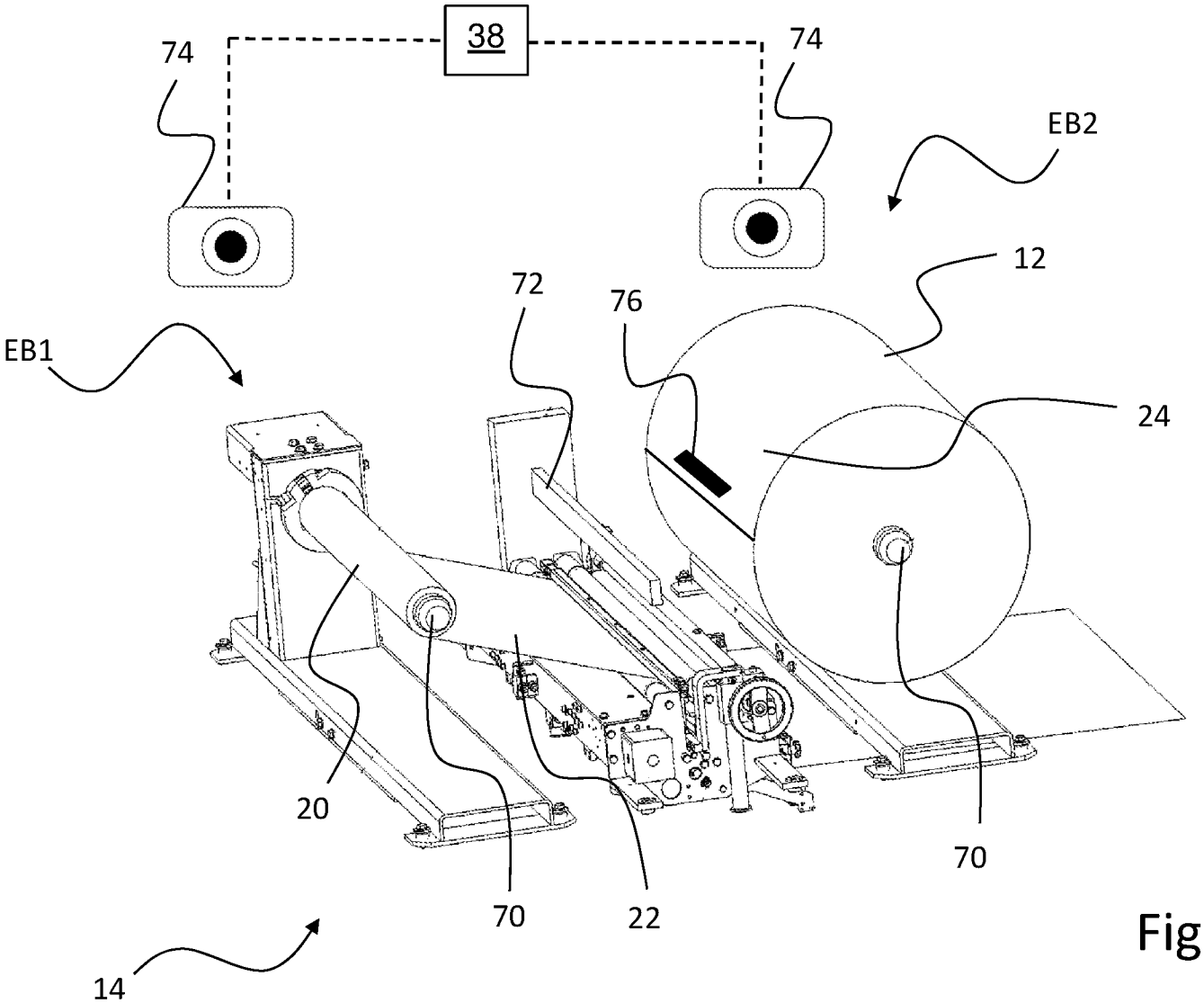
FIG. 4 shows the installation positions of FIG. 3 with a mounted new roll for the second installation position.
Figure 5:
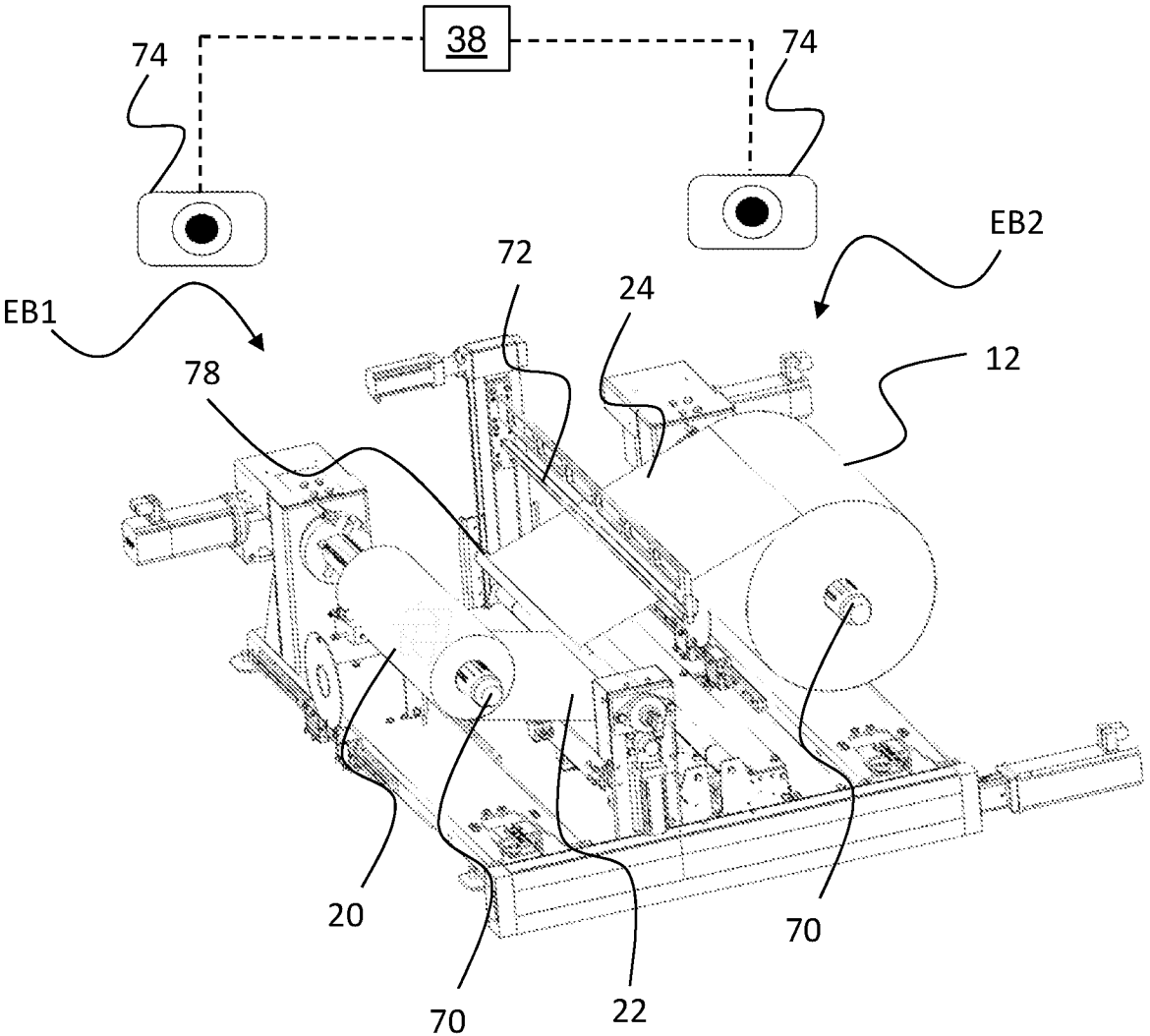
FIG. 5 shows the installation positions of FIGS. 3 and 4 with extracted outer layer of the new roll mounted into the second installation position.

As shown by the FIGS. 3 to 5 in conjunction with FIG. 1, individual new rolls 12 are mounted into one of the two installation positions EB1 or, as the case may be, EB2, by the gripping device and/or handling device 16 or, as the case may be, by the multi axis robot or handling robot 18, while a used-up or partly used-up roll 20 is still located in the other installation position EB2 or, as the case may be, EB1, from which roll 20 a material web 22 thereon continues to be unwound and processed as packaging material in the packaging machine 14, even while the particular new roll 12 is being mounted. During the further unwinding of the material web 22 from the almost depleted roll 20, attaching or, as the case may be, heat-sealing of the outer layer 24 (cf. FIG. 5) of the new roll 12 to the material web 22 is carried out, whereby the apparatus 10 can run in continuous operation without having to interrupt the packaging process for replacing a depleted roll 20 with a new roll 12.

The new rolls 12 are each composed of the wound-up, planar packaging material 22 or, as the case may be, of packaging film or shrink film, as well as of a core 26, onto which the packaging material 22 or, as the case may be, the shrink film is wound. For receiving a new roll 12 from a horizontal conveying device 28 indicated in FIG. 1, the handling device 16 or, as the case may be, the handling robot 18 dips face-side into a core 26 of a new roll 12 by a retaining mandrel 32 that is movably disposed at the end of its movable cantilever arm 30. For this purpose, an arm section 34 of the handling device 16 or, as the case may be, of the handling robot 18 can be rotatingly moved about an axis of rotation 36, as is exemplarily shown in FIG. 6A. After the retaining mandrel 32 dips into the core 26, the cross-sectional diameter of the retaining mandrel 32 is increased such that the new roll 12 is clampingly fixed to the retaining mandrel 32, as is also shown in FIG. 6B. The core 26 is formed as a hollow cylinder, with the form of the retaining mandrel 32 corresponding hereto, such that the retaining mandrel 32 is linked by its outer circumference to an inner cover surface of the core 26 for the purpose of clampingly fixing the new roll 12.

New rolls 12 can be supplied to the gripping device and/or handling device 16 or, as the case may be, to the handling robot 18 by the horizontal conveying device 28 in uninterrupted succession such that another new roll 12 is moved further toward the handling device 16 or, as the case may be, moves up toward the gripping device and/or handling device 16 when a new roll 12 is removed from the horizontal conveying device 28. According to requirements, the horizontal conveying device 28 can be operated as desired in a clocked manner or continuously at a constant speed. The operation of the horizontal conveying device 28 is specified by a control unit 38, which is only schematically indicated here, and which not only controls the horizontal conveying device 28 in its conveying speed and/or clocking, but rather also controls the handling robot 18 in its movements as well as parts of the packaging machine 14, as will be described on the basis of the FIG. 8 *ff* in more detail below.

The control unit 38 can process, for example, the signals 40 of at least one room monitoring device 42, which can be formed, in particular, by an optical detection device or, as the case may be, by a camera 44, potentially also by a plurality of cameras 44, which at least detect the movement range 46 of the multi-axis robot 18 and its movements, which is also meant to include the precise movements of the cantilever arm 30 with the retaining mandrel 32 disposed pivotably movable thereon in relation to each new roll 12 to be taken hold of. For purposes of better illustration, the movement range 46, which is optically detectable by the room monitoring device 42 formed by the camera 44, is indicated by a fan of beams in dotted lines in the presentation of FIG. 1.

Furthermore discernible in FIG. 1 is a manipulator 48 positioned in the area of the horizontal conveying device 28, which manipulator 48 is operated by a user 50, and by which manipulator 48 new rolls 12 can be placed standing upright onto the horizontal conveying device 28. The new rolls 12 can be supplied, for example, standing upright on a pallet 52, from which the user 50 can receive them by the manipulator 48 that is user-controllable in its movements, and can place them on the horizontal conveying device 28 by the retaining mandrel 54 located on the manipulator 48. An operating range of the manipulator 48 therefore extends across the pallet 52 as well as across a conveyor line section of the horizontal conveying device 28. The control and supply variant shown here, however, only represents one example of numerous conceivable alternatives. Likewise possible are continuously operating supply variants, which require no supporting manual handling as is described on the basis of FIG. 1. When the supply is not sorted in this way, it can be useful to provide an intermediate deposit for the new rolls 12 in the movement range 46 of the gripping and handling device 16 in order to be able, in the event of the retaining mandrel 32 of the handling robot 18 having taken hold of the rolls 12 non-rotation-direction-conformingly, to deposit the rolls 12 there, to extract the retaining mandrel 32 from the core 26, and take hold of the roll 12 again at its other end face so as to be able to mount it into the packaging machine 14 in the particularly required direction of rotation for the installation positions EB1 or EB2. Such an intermediate deposit 60, its mode of operation, and its interaction with the gripping device and/or handling device 16 as well as with the room monitoring device 42 are exemplarily explained in more detail on the basis of the embodiment variant of FIG. 2. In the variant of the apparatus 10 shown in FIG. 1, the user 50 still has the task to take care in each case of the correct positioning of the rolls 12 on the horizontal conveying device 28, in particular also with regard to their correct direction of rotation in the particular installation position EB1 or EB2 (cf. in this context the FIGS. 3 to 5).

FIG. 1 furthermore shows a container 56 that is open at the top and that is located in the operating range 46 of the gripping device and/or handling device 16. When the supply of packaging material or, as the case may be, of shrink film of one of the rolls 12 placed in the packaging machine 14 is exhausted, the cellulose, plastic, wood, or cardboard core 26 of an empty roll 20 is removed from the packaging machine 14 and deposited in the container 56 by the handling robot 18. Only after removing the core 26 can a new roll 12 be mounted in the particular installation position EB1 or EB2, as the case may be, of the packaging machine 14 such that the gripping device and/or handling device 16 or, as the case may be, the handling robot 18 first removes the core 26 and temporally after that mounts a new roll 12 into the particular installation position EB1 or EB2, as the case may be.

As already mentioned, the horizontal conveying device 28, the gripping device and/or handling device 16 or, as the case may be, the multi-axis robot 18, and the packaging machine 14 are linked to the control unit 38. Said control unit 38 can, in particular, control the clocked operation of the horizontal conveying device 28, and initiate rolls 12 or, as the case may be, rolls 20 to be mounted into and removed from the two installation positions EB1 and EB2 by the handling device 16. Said control unit 38 can moreover control an unrolling of packaging material or, as the case may be, of shrink film from the rolls 12 mounted in the packaging machine 14, as is described in more detail below. In addition, the room monitoring device 42 in interaction with the control unit 38 can enable a movement control of the horizontal conveying device 28 and, in particular, of the gripping device and/or handling device 16, thus allowing fault-tolerant positioning and supply of the new rolls 12 as well as their handling, because it can be effectively supported and controlled by the at least one camera 44 that each new roll 12 is accurately taken hold of by the retaining mandrel 32 of the handling robot 18 such that the accurate positioning of the rolls 12 on the horizontal conveying device 28 becomes less important and can be compensated for by the correspondingly updated movement control of the handling robot 18 within its range of movement 46.

The positioning of the camera 44 indicated in FIG. 1 is to be understood merely as an example. A camera 44 or a plurality of cameras 44 can likewise be positioned at other locations, for example, also in the area of the packaging machine 14, in the area of the handling robot 18 or, if applicable, even on its swivel arm 30, if the movement range 46 can thus be covered and detected in the required manner.

The control unit 38 can moreover have a visual indicator device 58 or a display, by which information can be visualized for the user 50 relating to the direction of rotation or, as the case may be, the rotation-direction-conforming orientation of new rolls 12 and/or further control parameters or, as the case may be, movement parameters of the multi-axis robot 18 and/or of the horizontal conveying device 28. As exemplarily described below with reference to the FIGS. 3 to 5, the direction of rotation or, as the case may be, the rotation-direction-conforming orientation of the new rolls 12 is preferably determined and/or verified by the camera 44 or potentially also by a further camera, which camera or cameras 44 is or are linked to the control unit 38, as the case may be. Since the gripping device and/or handling device 16 can remove the particular core 26 of an empty roll 20 from the packaging machine 14, and, supported by the camera 44 or, as the case may be, by further cameras, autonomously mounts new rolls 12 into the packaging machine 14 with appropriate direction of rotation or, as the case may be, rotation-direction-conforming orientation, the apparatus 10 can be operated completely automated at least from the point of receiving new rolls 12 from the horizontal conveying device 28.

Figure 2:
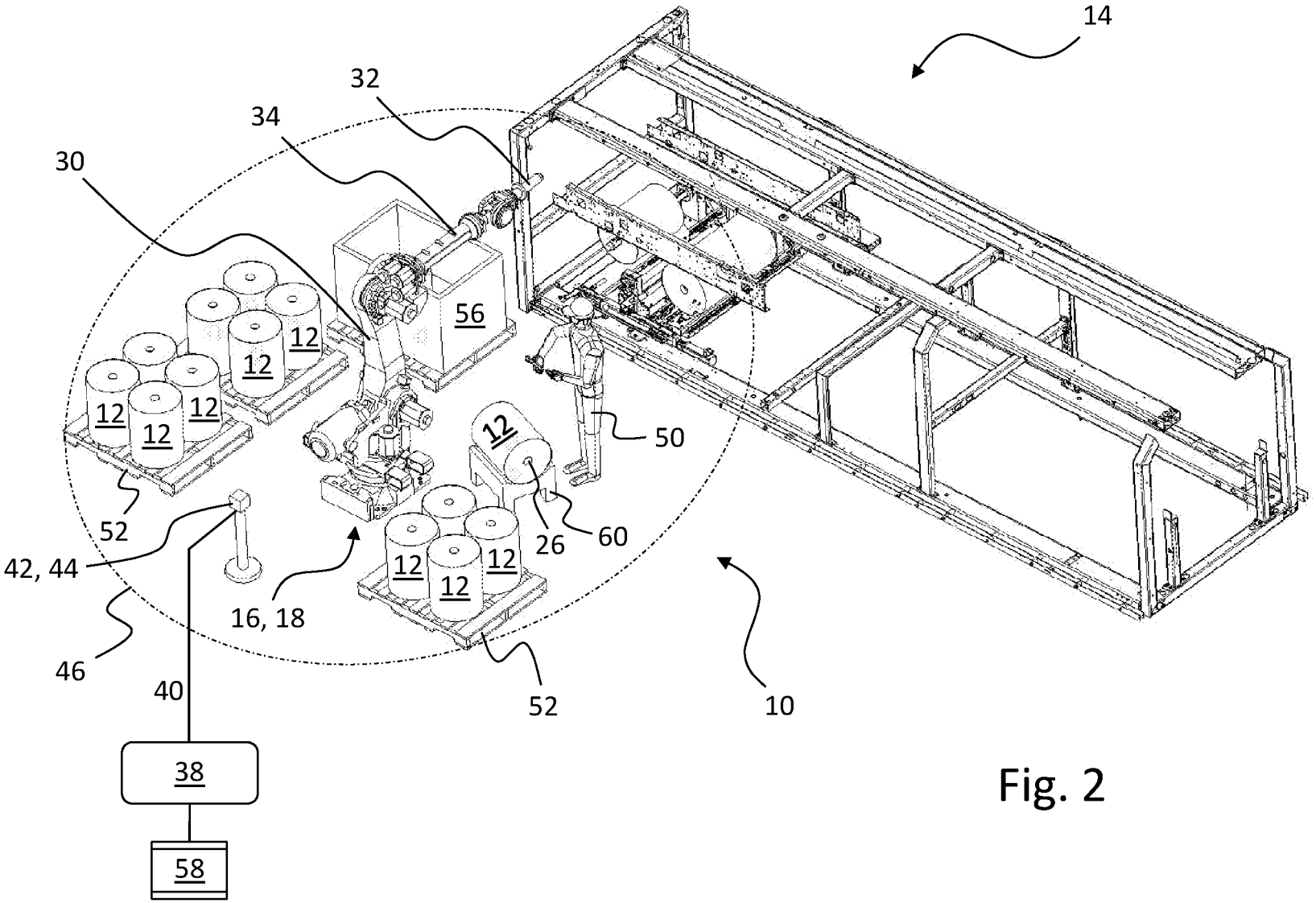
FIG. 2 shows a schematic perspective view of a second embodiment variant of the apparatus according to the invention and an expedient implementation of an embodiment for the method according to the invention.

The schematic perspective view of FIG. 2 shows a second embodiment variant of the apparatus 10 according to the invention as well as an expedient implementation of an embodiment for the method according to the invention. The packaging machine 14 is not significantly different from the previously described variant according to FIG. 1. Here, the apparatus 10 again serves for handling planar packaging material, such as shrink film or packaging films, which are provided individually on rolls 12 to the packaging machine 14 by the gripping device and/or handling device 16 designed as multi-axis robot 18 in correspondence with the consumption-related replenishment requirement. As in the first variant according to FIG. 1, the gripping device and/or handling device 16 mounts the new rolls 12 to be fed in each case to the packaging machine 14 into two different installation positions EB1 and EB2, which will be explained in more detail by the detailed views of the FIGS. 3 to 5.

The second variant of the apparatus 10 shown in FIG. 2 dispenses with a horizontal conveying device and instead has the new rolls 12 delivered in each case on pallets 52, with four rolls 12 being disposed standing upright on each pallet 52, and being individually taken up by the handling robot 18 and mounted into the packaging machine 14. For taking a new roll 12 from a pallet 52 standing within reach, that is to say, within the range of movement 46 of the gripping device and/or handling device 16 or, as the case may be, of the multi-axis robot 18, the handling device 16 or, as the case may be, the handling robot 18 dips face-side into a core 26 of a new roll 12 by the retaining mandrel 32 that is movably disposed at the end of its movable cantilever arm 30, as already explained by FIG. 1. For this purpose, an arm section 34 of the handling device 16 or, as the case may be, of the handling robot 18 can be rotatingly moved about an axis of rotation 36, as is exemplarily shown in FIG. 6A. After the retaining mandrel 32 dips into the core 26, the cross-sectional diameter of the retaining mandrel 32 is increased such that the new roll 12 is clampingly fixed to the retaining mandrel 32, as is also shown in FIG. 6B. The core 26 is formed as a hollow cylinder, with the form of the retaining mandrel 32 corresponding hereto such that the retaining mandrel 32 is linked by its outer circumference to an inner cover surface of the core 26 for the purpose of clampingly fixing the new roll 12.

By the pallets 52 being regularly delivered into the movement range 46 with four new rolls 12 each, the gripping device and/or handling device 16 or, as the case may be, the handling robot 18 is provided in uninterrupted succession with new rolls 12 such that upon the removal of all new rolls 12 from a pallet 52, this empty pallet 52 can be replaced by a new pallet 52 with four further rolls 12, which new pallet 52 is in turn to be placed within the movement range 46 of the gripping device and/or handling device 16. This supply delivery can be carried out by suitable industrial trucks, for example by driverless transport systems, so-called AGVs (automated guided vehicles), which are formed by transport vehicles that are self-driving, remote-controlled, and/or that have their own sensor systems for steering, with the transport vehicles being able in each case to convey a pallet 52 with rolls 12 placed thereon into the movement range 46. According to requirements, said transport systems or, as the case may be, said AGVs can be operated as desired in a clocked manner. Their operation is preferably specified by the schematically indicated control unit 38, which not only controls the AGVs (not shown here) in their conveying speed and/or clocking, but rather also controls the handling robot 18 in its movements for replacing the rolls 12 in the packaging machine 14. The control unit 38 can in addition process the signals 40 of at least one room monitoring device 42, which in the variant according to FIG. 2 can also be formed, in particular, by an optical detection device or, as the case may be, a camera 44, potentially also by a plurality of cameras 44, which at least detect the movement range 46 of the multi-axis robot 18 and its movements, which is also meant to include the precise movements of the cantilever arm 30 with the retaining mandrel 32 disposed pivotably movable thereon in relation to each new roll 12 to be taken hold of. For purposes of better illustration, the movement range 46, which is optically detectable by the room monitoring device 42 formed by the camera 44, is indicated by an ellipse in dotted lines in the presentation of FIG. 2.

Due to the sufficiently dimensioned movement range 46, it is not only possible to dispense with the horizontal conveying device in the variant of the apparatus according to FIG. 2, but also to dispense with the manipulator interacting with said horizontal conveying device, by which new rolls 12 can be placed standing upright onto the horizontal conveying device (cf. FIG. 1). Since the direction of rotation of the rolls 12 on the pallets 52 is normally not defined, an intermediate deposit 60 is, by contrast, provided in the movement range 46 of the gripping and handling device 16 and in its immediate vicinity in the variant of the apparatus 10 shown in FIG. 2, which intermediate deposit 60 serves for being able to ensure the rotation-direction-conforming positioning that is indispensable for each roll 12 when being mounted into the packaging machine 14. In practice, the retaining mandrel 32 of the handling robot 18 takes hold of each individual roll 12 standing on the pallet 52 without already verifying the direction of rotation. Whether it will be possible to position the roll 12 directly in the packaging machine 14 without transposing it or whether it possibly has the wrong direction of rotation, is verified by suitable optical monitoring or by detection in a different manner (for example, inductively, by a transponder, or the like) while the cantilever arm 30 moves with the roll 12 being conveyed on the retaining mandrel 32 toward the packaging machine 14. If the roll 12 has the wrong direction of rotation, it can be deposited on the intermediate deposit 60 by a corresponding movement control of the handling robot 18, whereupon the retaining mandrel 32 is retracted from the core 26 of the deposited roll 12, with the roll 12 to be taken hold of again at its other end face so as to be able to subsequently mount it into the packaging machine 14 in the particularly required direction of rotation for the installation positions EB1 or EB2.

The user 50 standing within the range of movement 46 in FIG. 2 is normally only present for maintenance purposes, however not during ongoing operation of the gripping device and/or handling device 16; and this can likewise be monitored by the room monitoring device 42, if applicable.

The container 56 that is open at the top and that is located in the operating range 46 of the gripping device and/or handling device 16 is also discernible in FIG. 2. When the supply of packaging material or, as the case may be, of shrink film of one of the rolls 12 placed in the packaging machine 14 is exhausted, the cellulose, plastic, wood, or cardboard core 26 of an empty roll 20 is removed from the packaging machine 14 and deposited in the container 56 by the handling robot 18. Only after removing the core 26 can a new roll 12 be mounted in the particular installation position EB1 or EB2, as the case may be, of the packaging machine 14, such that the gripping device and/or handling device 16 or, as the case may be, the handling robot 18 first removes the core 26 and temporally after that mounts a new roll 12 into the particular installation position EB1 or EB2, as the case may be.

As already mentioned, the gripping device and/or handling device 16 or, as the case may be, the multi-axis robot 18, the controllable intermediate deposit 60 for the rolls 12, and the packaging machine 14 are linked to the control unit 38, which, for delivering the pallets 52, can in addition control the AGVs, which are to be understood as optional and are not shown here. The control unit 38 can thus, in particular, control the clocked operation of the AGVs, can initiate mounting and removing of rolls 12 or rolls 20, as the case may be, from the two installation positions EB1 and EB2 by the handling device 16, as well as controlling the intermediate deposit 60, if applicable, to be used for ensuring the correct direction of rotation of a new roll 12 to be mounted. Said control unit 38 can moreover control an unrolling of packaging material or, as the case may be, of shrink film from the rolls 12 mounted in the packaging machine 14, as is described in more detail below. In interaction with the control unit 38, the room monitoring device 42 can enable a movement control of the gripping device and/or handling device 16, including, as required, the intermediate deposit 60, thus making a fault-tolerant positioning and supplying of the new rolls 12 on the not accurately positioned pallets 52 as well as the handling of the received rolls 12 possible, since the accurate seizing of each new roll 12 by the retaining mandrel 32 of the handling robot 18 can be effectively supported and controlled by the at least one camera 44 such that the accurate positioning of the rolls 12 on the pallets 52 or, as the case may be, the accurate positioning of the pallets 52 themselves on the ground in the area of the movement range 46 becomes less important and can be compensated for by the correspondingly updated movement control of the handling robot 18 within its range of movement 46.

The positioning of the camera 44 indicated in FIG. 2 is to be understood merely as an example. A camera 44 or a plurality of cameras 44 can likewise be positioned at other locations, for example, also in the area of the packaging machine 14, in the area of the handling robot 18 or, if applicable, also on its swivel arm 30, if the movement range 46 can thus be covered and detected in the required manner. The camera 44 or, as the case may be, the room monitoring device 42 can optimally fulfill its purpose if it can largely completely cover the movement range 46 and if it can accurately detect and follow the movements of the gripping device and/or handling device 16 and of its retaining mandrel 32, and the different target positions of the retaining mandrel 32 when receiving and positioning the rolls 12. In order to reliably ensure this, it can be expedient to provide the rolls 12, at least, however, the retaining mandrel 32, optionally the swivel arm 30 of the handling robot 18 as well, with suitable reference marks, which can be formed, for example, by marks that are optically clearly identifiable in the area such that they can serve as clearly identifiable and spatially assignable markings for the camera system 44.

The control unit 38 can moreover have a visual indicator device 58 or a display, by which information can be visualized for the user 50 relating to the direction of rotation or, as the case may be, to the rotation-direction-conforming orientation of new rolls 12 and/or further control parameters or, as the case may be, movement parameters of the multi-axis robot 18 and/or of the AGVs. As exemplarily described below with reference to the FIGS. 3 to 5, the direction of rotation or, as the case may be, the rotation-direction-conforming orientation of the new rolls 12 is preferably determined and/or verified by the camera 44 or potentially also by a further camera, which camera or cameras is or are, as the case may be, linked to the control unit 38. Since the gripping device and/or handling device 16 can remove the particular core 26 of an empty roll 20 from the packaging machine 14, and, supported by the camera 44 or, as the case may be, by further cameras, autonomously mounts new rolls 12 into the packaging machine 14 with appropriate direction of rotation or, as the case may be, rotation-direction-conforming orientation, the apparatus 10 can be operated largely automated at least from the point of receiving new rolls 12 from the particular pallet 52.

With reference to the FIGS. 1 and 2 it should be added here that it is optionally also possible to implement two or three of such devices as the shown gripping device and/or handling device 16 or, as the case may be, as the handling robot 18 forming it, if the movement ranges 46 of the two or more handling robots 18 are coordinated with each other in such a manner that no collisions can occur. Normally, however, the use of two or more handling robots 18 will not be necessary, since the rolls 12 do not need to be replaced very often due to the length of the material webs on the rolls 12 ensuring a longer, interruption-free operation.

Nevertheless, an expedient embodiment variant can provide that a gripping device and/or handling device 16 or, as the case may be, an individual handling robot 18 can supply two packaging lines or, as the case may be, two packaging machines 14 in each case, with the movement range 46 being expediently located between the two approximately parallely disposed packaging machines 14 such that the feeding area for new rolls 12 with the horizontal conveying device 28 (cf. FIG. 1) or, as the case may be, with the pallet supply (cf. FIG. 2) is also located between the two packaging machines 14 and in the vicinity of the handling robot 18 as well as within its range of movement 46. In this instance, the handling robot 18 can alternately supply the two packaging machines 14 that are in regular operation in each case with new rolls 12 and transfer the used-up rolls 20, if applicable, in a collective container 56 for following disposal or, as the case may be, for cyclic disposal. If the movement range 46 is not to be monitored by one single camera 44, for example because the camera 44 is partly shaded, a plurality of cameras 44 can potentially be present for room monitoring.

In an alternative embodiment variant of the arrangement or apparatus 10 according to the invention not illustrated here, however, it is even possible to completely dispense with the mentioned gripping device and/or handling device 16 or, as the case may be, with the handling robot 18 as shown in the FIGS. 1 and 2 if the rolls 12 are conveyed directly up to the packaging machine 14 by a suitable feeder device, which is formed, for example, by the correspondingly extended horizontal conveying device 28 (cf. FIG. 1, FIG. 2), and received there and pulled and conveyed into the particular installation positions EB1, EB2, if required, by the receiving mandrels 70 (cf. the FIG. 3 *ff*) that are designed as active roll receivers. If "feeder devices" are referred to in the present context, this is intended to comprise feeder belts, horizontal conveying devices 28, modular belt conveyors, or the like. The feeder devices can likewise be formed by suitable AGVs (driverless, preferably autonomously or partly autonomously driving transport systems, so-called shuttles), which convey the new rolls 12 directly up to the packaging machine 14 and, if required, there supply the rolls 12 to the receiving mandrels 70, which in this case function as active roll receivers and can take the new rolls from the AGVs and bring them into the particular installation positions EB1, EB2 in the packaging machine 14.

The schematic perspective view of FIG. 3 illustrates the already previously mentioned installation positions EB1 and EB2 for the rolls 12, which are defined in the packaging machine 14 according to the variants pursuant to FIG. 1 and/or FIG. 2. Each of the installation positions EB1 and EB2 is defined by an own rotatable receiving mandrel 70. Each of these receiving mandrels 70, which each has a separate drive for the rotation of said mandrels 70 associated with it, is moreover movable in axial direction, in particular, by motor drives, as will be explained in more detail on the basis of the FIG. 7 further below. A new roll 12 is placed in each case by the gripping device and/or handling device (cf. FIGS. 1 and 2) onto each of said two horizontally oriented receiving mandrels 70 and clampingly fixed by increasing the diameter of the receiving mandrels 70 and by clamping the roll core 26 to the particular receiving mandrel 70. According to the invention, the replacement of the rolls 12 or, as the case may be, the rolls 20 is supported and facilitated by corresponding axial movements of the receiving mandrels 70, as will be explained in further detail below.

Also discernible in FIG. 3 is a sealing bar 72, which is provided for attaching an outer layer 24 (cf. FIG. 4, FIG. 5) of the new roll 12 mounted in the particular installation position EB1 or EB2, as the case may be (cf. FIG. 4), to the material web 22 remaining in the packaging machine 14, and which is vertically lowered for this purpose. After attaching the outer layer 24 (cf. FIG. 4) to the material web 22 remaining in the packaging machine 14, the temperature-controlled sealing bar 72 is vertically lifted and brought into the position illustrated in FIG. 3.

In the presentation of FIG. 3, an almost used-up roll 20 is positioned in the first installation position EB1 on the receiving mandrel 70 of the first installation position EB1 and is rotatingly moved by the mandrel 70 or, as the case may be, by extracting the material web 22. In the process, the packaging material or, as the case may be, the shrink film of the roll 20 positioned on the receiving mandrel 70 of the first installation position EB1 is unwound. In the second installation position EB2, a used-up roll 20 has already been completely unwound and the core 26 (cf. FIGS. 1 and 2) removed by the handling device 16 such that the second installation position EB2 or, as the case may be, the receiving mandrel 70 of the second installation position EB2 is ready for receiving a new roll 12 of packaging material.

Each of the installation positions EB1 and EB2 can in addition be associated with an own sensor system or, as the case may be, with a camera 74, by which rolls 20, which are at least approximately completely unwound and/or depleted, can be optically detected. When a roll 20 is at least approximately completely unwound and/or depleted, the particular camera 74 sends information on the particular roll 20, which is at least approximately completely unwound and/or depleted, to the control unit 38. Based on numerous data, also from the cameras 74 within the packaging machine 14, the control unit 38 already mentioned above controls the gripping device and/or handling device 16 or, as the case may be, the handling robot 18 (cf. FIGS. 1 and 2) for the removal of the particular, at least approximately completely unwound and/or depleted roll 20 or, as the case may be, for the removal of the core 26 of the particular, at least approximately completely unwound and/or depleted roll 20. In order to be able to remove the at least approximately completely unwound and/or depleted roll 20 from its particular installation position EB1 or EB2, as the case may be, a clamping connection formed between the particular roll 20 and the receiving mandrel 70 is first undone. This is typically carried out by reducing the cross-sectional diameter of the particular receiving mandrel 70, whereby the roll core 26 can be extracted. Undoing the clamping connection or, as the case may be, reducing the cross-sectional diameter of the receiving mandrels 70 is furthermore controlled by the control unit 38, as is the axial shifting of the mandrels 70 for better communication with the gripping device and/or handling device 16 or, as the case may be, with the handling robot 18 and its retaining mandrel 32.

For the purpose of removing the at least approximately completely unwound and/or depleted roll 20 from its particular installation position EB1 or EB2, as the case may be, the receiving mandrel 70 is axially moved out of the packaging machine 14, and the gripping device and/or handling device 16 dips by its retaining mandrel 32 (cf. FIG. 6A) into the core 26 of the at least approximately completely unwound and/or depleted roll 20. This is supported by an axial stop explained in detail further below, with the stop interacting with an axially movable receiving mandrel 70 in such a manner that the roll 20 is slipped off. After having been slipped off of the receiving mandrel 70 of the packaging machine 14, the particular at least approximately completely unwound and/or depleted roll 20 is then fixed to the retaining mandrel 32 of the handling device 16 by increasing the cross-sectional diameter of the retaining mandrel 32. Increasing the cross-sectional diameter of the retaining mandrel 32 for fixing the roll 20 or, as the case may be, the roll core 26, is likewise controlled by the control unit 38. After fixing the at least approximately completely unwound and/or depleted roll 20 to the retaining mandrel 32, the at least approximately completely unwound and/or depleted roll 20 is moved toward the container 56 (cf. FIGS. 1 and 2) by the gripping device and/or handling device 16 and under control by the control unit 38, and it is deposited there in the container 56 by decreasing the cross-sectional diameter of the retaining mandrel 32.

After depositing the at least approximately completely unwound and/or depleted roll 20 or, as the case may be, the core 26 in the container 56 (cf. FIGS. 1 and 2), the gripping device and/or handling device 16 is activated by the control unit 38 for mounting a new roll 12 into the particular installation position EB1 or, as the case may be, EB2 within the packaging machine 14. A verification of the direction of rotation or, as the case may be, of the rotation-direction-conforming orientation of the particular new roll 12 can be carried out prior to that—preferably with the help of the intermediate deposit 60 (cf. FIG. 2)—as already described above. The apparatus 10 can be operated automatedly in this manner. It should be noted here that the exemplary embodiment according to FIG. 3 is intended to be understood merely as an example, such that further embodiments are conceivable in which there is only one camera 74 associated with the two installation positions EB1 and EB2, where the detection range of the camera 74 extends across the two installation positions EB1 and EB2. It is also possible by the cameras 74 to verify a direction of rotation or, as the case may be, rotation-direction-conforming orientation of new rolls 12 mounted in the installation positions EB1 and EB2. If a wrong direction of rotation or, as the case may be, a non-rotation-direction-conforming orientation of new rolls 12 is determined in one of the two installation positions EB1 or EB2, as the case may be, an alignment correction of the particular new roll 12 by the gripping device and/or handling device 16 can be induced by the control unit 38. The gripping device and/or handling device 16 can then remove the particular new roll 12 from its particular installation position EB1 or EB2, as the case may be, deposit it on the intermediate deposit 60 (cf. FIG. 2), pick up the roll 12 again with the appropriate direction of rotation and/or rotation-direction-conforming orientation, and hereupon mount it again with the appropriate direction of rotation and/or rotation-direction-conforming orientation into its particular installation position EB1 or EB2, as the case may be.

The further schematic perspective view in FIG. 4 shows the installation positions EB1 and EB2 according to FIG. 3 with the mounted new roll 12 for the second installation position EB2. Compared to FIG. 3, a new roll 12 has now been slid onto the receiving mandrel 70 of the second installation position EB2 by the gripping device and/or handling device 16 (cf. FIGS. 1 and 2) in the illustration of FIG. 4, after the receiving mandrel 70 was axially moved out of its installation position EB2 for this purpose and returned into the packaging machine 14 after positioning the new roll 12. Packaging material 22 or, as the case may be, shrink film continues to be unwound from the roll 20 of the first installation position EB1, which roll 20 is almost used-up or, as the case may be, almost unwound and therefore soon to be removed, such that the packaging machine 14 (cf. FIGS. 1 and 2) can continue to be operated even while replacing the roll 20 from the first installation position by switching to the new roll 12 of the second installation position EB2. If a new roll 12 is subsequently mounted in the first installation position EB1, packaging material 22 or, as the case may be, shrink film can continue to be unwound from the roll 12 in the second installation position EB2, thus making it possible to ensure the required continuous and interruption-free operation of the packaging machine 14.

The new roll 12 of the second installation position EB2 from FIG. 4 can optionally have an optically identifiable adhesive label 76, which can be formed, in particular, by a reflective or inductively or otherwise detectable adhesive label 76, which is applied onto the outer layer 24 of the new roll 12 in the area of its free end. The camera 74 associated with the second installation position EB2 is now able to verify by the adhesive label 76 whether the new roll 12 has been slid onto the receiving mandrel 70 with the appropriate direction of rotation or, as the case may be, with rotation-direction-conforming orientation. The FIGS. 4 and 5 in conjunction can illustrate that the outer layer 24 of the new roll 12 of the second installation position EB2 is guided from above over the roll 12 and dips downward. If the roll 12 had been positioned on the receiving mandrel 70 of the second installation position EB2 with a wrong direction of rotation or, as the case may be, with a non-rotation-direction-conforming orientation, the outer layer 24 would face downward away from the roll 12 and could therefore not or only with difficulty be gripped. This could moreover potentially disturb the unwinding behavior within the packaging machine 14 or, as the case may be, disturb the flow of the material web. An alignment below the sealing bar 72 would thus not be possible. A rotation-direction-conforming positioning of new rolls 12 or, as the case may be, a mounting of new rolls 12 into the particular installation position EB1 or EB2 with the appropriate direction of rotation is thus indispensable in order to be able to ensure disruption-free operation of the apparatus 10 or, as the case may be, of the packaging machine 14 in the subsequent material conveyance of the material webs 22.

As soon as the adhesive label 76 has been detected by the particular camera 74, the receiving mandrel 70 is rotatingly moved until the adhesive label 76 faces toward the oppositely located installation position EB1 or EB2, as the case may be. Only after this alignment of the adhesive label 76 is it possible for a gripping rod 78 (only schematically illustrated in FIG. 5) of a gripping device and/or handling device (not illustrated), which is movable in the packaging machine 14 between the installation positions EB1 and EB2 and the sealing bar 72, to grip the outer layer 24 of the new roll 12 and position it below the sealing bar 72. This gripping rod 78 can suction up the outer layer 24 of the roll 12, for example by negative pressure, and grip it.

It should be pointed out, however, that embodiments are also conceivable in which the new rolls 12 have no such reflective adhesive labels 76 (corresponding to FIG. 4) and in which the cameras 74 detect an externally located layer 24 of new rolls 12 or, as the case may be, the free end sections of new rolls 12, without additional optical markers of the new rolls 12. Preferably, however, the optically detectable adhesive labels 76 have an encoding—not illustrated in further detail here—that can be identified by the cameras 74. Besides localizing the end section of the outer layer 24, said encoding can preferably also clearly mark the direction of rotation of roll 12 such that the adhesive label 76 can already be used when handling the roll 12 to be newly mounted with the handling robot 18 for the purpose of determining the direction of rotation and for correctly positioning the end section of the outer layer 24, potentially also including the intermediate deposit 60. In this context, the adhesive label 76 can preferably be detected by the room monitoring devices 42 or, as the case may be, by the camera 44, and the information content can be evaluated and provided to the control unit 38 for the purpose of controlling the handling robot 18 and/or the intermediate deposit 60 in the manner required.

The schematic perspective view of FIG. 5 shows the installation positions EB1 and EB2 of FIGS. 3 and 4 with extracted outer layer 24 of the new roll 12 mounted into the second installation position EB2. It is clearly discernible here that the externally located layer 24 of the roll 12, which is positioned in the second installation position EB2, dips downward coming from above, while the outer layer or, as the case may be, the material web 22 of the roll 20 mounted into the first installation position EB1 is guided coming from below. Both rolls 12 and 20 rotate on their particular, associated receiving mandrels 70 with the same direction of rotation, in this case counterclockwise. Rotation-direction-conforming mounting of the new rolls 12 is necessary in order to be able to ensure disruption-free and functioning operation of the apparatus 10 or, as the case may be, of the packaging machine 14 (cf. FIGS. 1 and 2).

It is thus possible both to determine a direction of rotation or, as the case may be, rotation-direction-conforming orientation within the packaging machine 14 via the cameras 74 and to detect at least approximately completely unwound and/or depleted rolls 20 via the cameras 74. Information on the direction of rotation or, as the case may be, on the rotation-direction-conforming orientation of new rolls 12, as well as information on at least approximately completely unwound and/or depleted rolls 20 is transmitted from the cameras 74 to the control unit 38, which can control an alignment correction of new rolls 12 and a replacement of at least approximately unwound and/or depleted rolls 20 with new rolls 12. This can in particular be carried out in a manner as already explained by FIG. 2, optionally including the intermediate deposit 60 that is usable for correcting the direction of rotation. In order to determine the correct direction of rotation, it is, however, expedient to primarily use the camera 44, and only subsequently the cameras 74 to once more verify the correct direction of rotation after mounting the rolls 12 in the packaging machine 14.

Figure 6A:
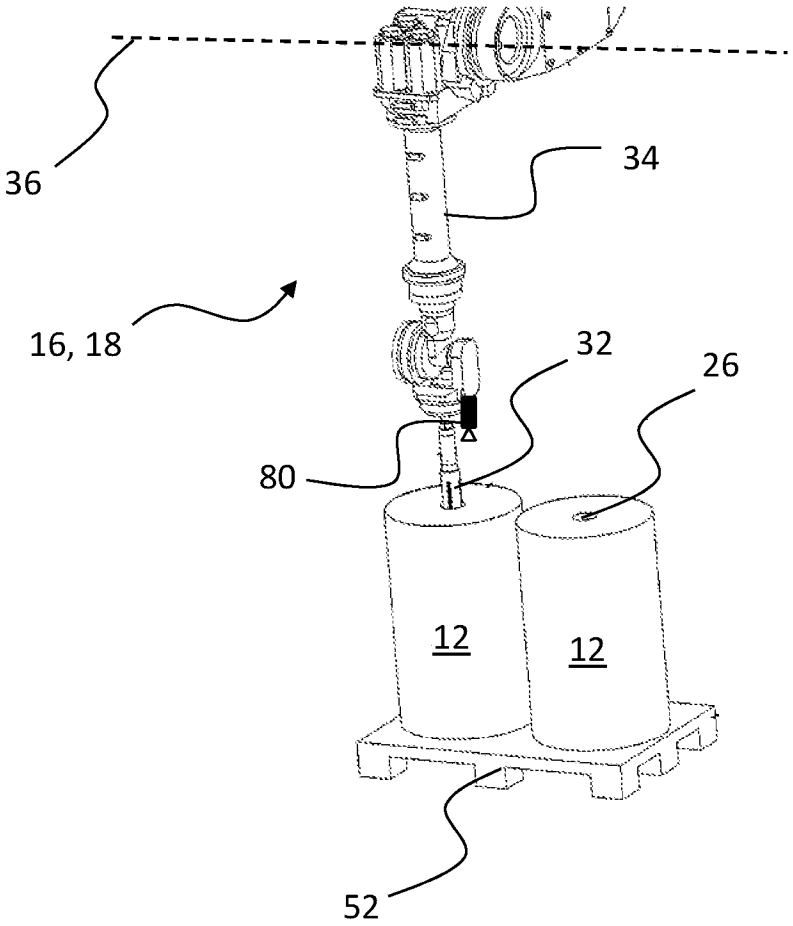
FIG. 6 shows a handling device in two perspective views, where the handling device takes up a new roll from a pallet in order to mount it into the packaging machine.
Figure 6B:
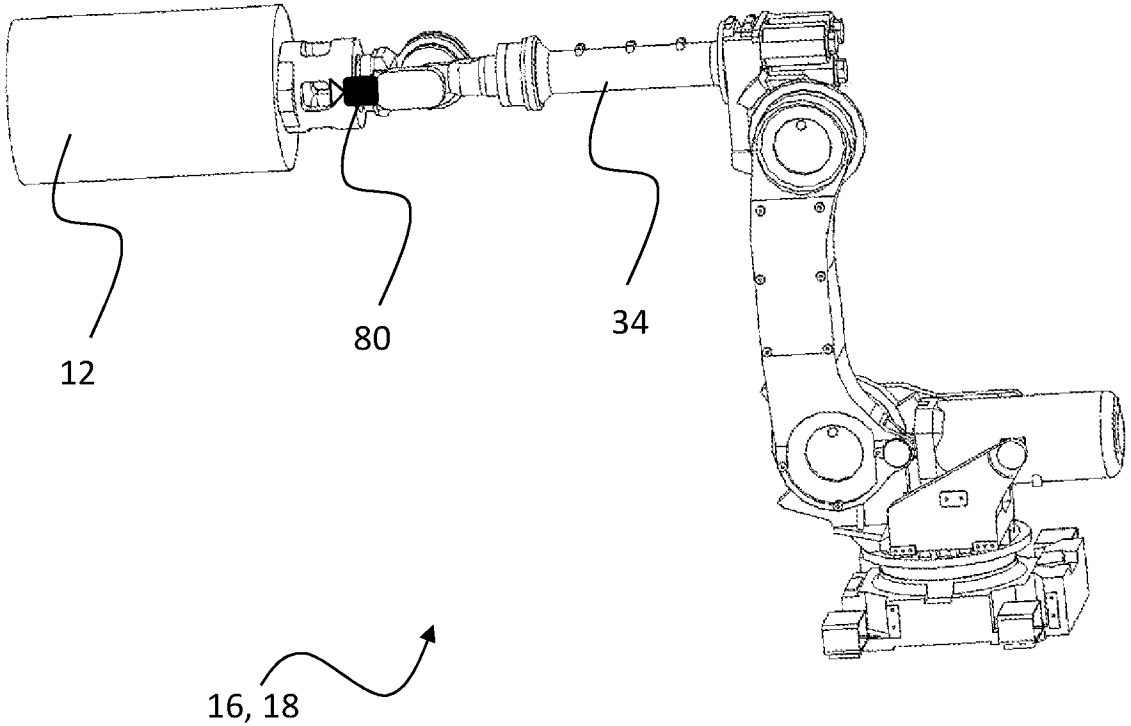

The schematic illustrations of FIGS. 6A and 6B show a part of the handling robot 18 that forms the gripping device and/or handling device 16 for handling the rolls 12 in the apparatus 10. The gripping arm or, as the case may be, the arm section 34 of the handling robot 18 is pivotable about the horizontally oriented axis 36 such that the retaining mandrel 32 of the handling robot 18 can be aligned with a vertical orientation of its longitudinal axis for the purpose of dipping into the core 26 of the particular new roll 12. If the particular new roll 12 has been taken hold of by the handling robot 18 or, as the case may be, by the retaining mandrel 32, the new roll 12 can be rotated about the axis 36 by a repeated pivoting motion of the gripping arm 34 and can temporally thereafter be mounted into its particular, associated installation position EB1 or EB2, as the case may be (cf. FIGS. 3 to 5).

The FIGS. 6A and 6B moreover show an optional further camera 80. Said optional camera 80 is mechanically fixedly coupled with the gripping arm 34 such that the camera 80 is guided together with the gripping arm 34 in a movement of the gripping arm 34. If the gripping arm 34 is pivoted about the axis 36, a direction of rotation or, as the case may be, rotation-direction-conforming orientation of one or more new rolls 12 can be determined by the camera 80. In order to enable a corresponding evaluation and movement control for the gripping device and/or handling device 16, the camera 80 is linked to the control unit 38, which controls a new roll 12 that has an appropriate direction of rotation or, as the case may be, rotation-direction-conforming orientation, to be taken from the pallet 52 by the handling device 16.

The FIG. 6B furthermore shows the gripping device and/or handling device 16 after taking a new roll 12 with rotation-direction-conforming orientation from a pallet 52 (cf. FIG. 6A). As is discernible in FIG. 6B and based on the position of the gripping arm 34 in FIG. 6A, the gripping arm 34 has been pivoted about the axis 36, which runs in the direction of the image plane in FIG. 6A. The new roll 12 now has an at least approximately horizontal orientation and can be mounted in the packaging machine 14 into its particular, associated installation position EB1 or EB2, as the case may be. The removal of the at least approximately completely unwound and/or depleted roll 20 from the particular installation position EB1 or EB2, as the case may be, is likewise carried out in a horizontal orientation. For the purpose of removing the at least approximately completely unwound and/or depleted roll 20 from its particular installation position EB1 or EB2, as the case may be, the retaining mandrel 32 of the handling robot 32 dips into the core 26 of the at least approximately completely unwound and/or depleted roll 20, this process being potentially supported by various auxiliary devices that will be explained below in more detail with reference to the FIGS. 8 and 9. The particular at least approximately completely unwound and/or depleted roll 20 is fixed to the retaining mandrel 32 of the handling robot 18 by increasing the cross-sectional diameter of the retaining mandrel 32. Increasing the cross-sectional diameter of the retaining mandrel 32 is controlled by the control unit 38.

Figure 7A:
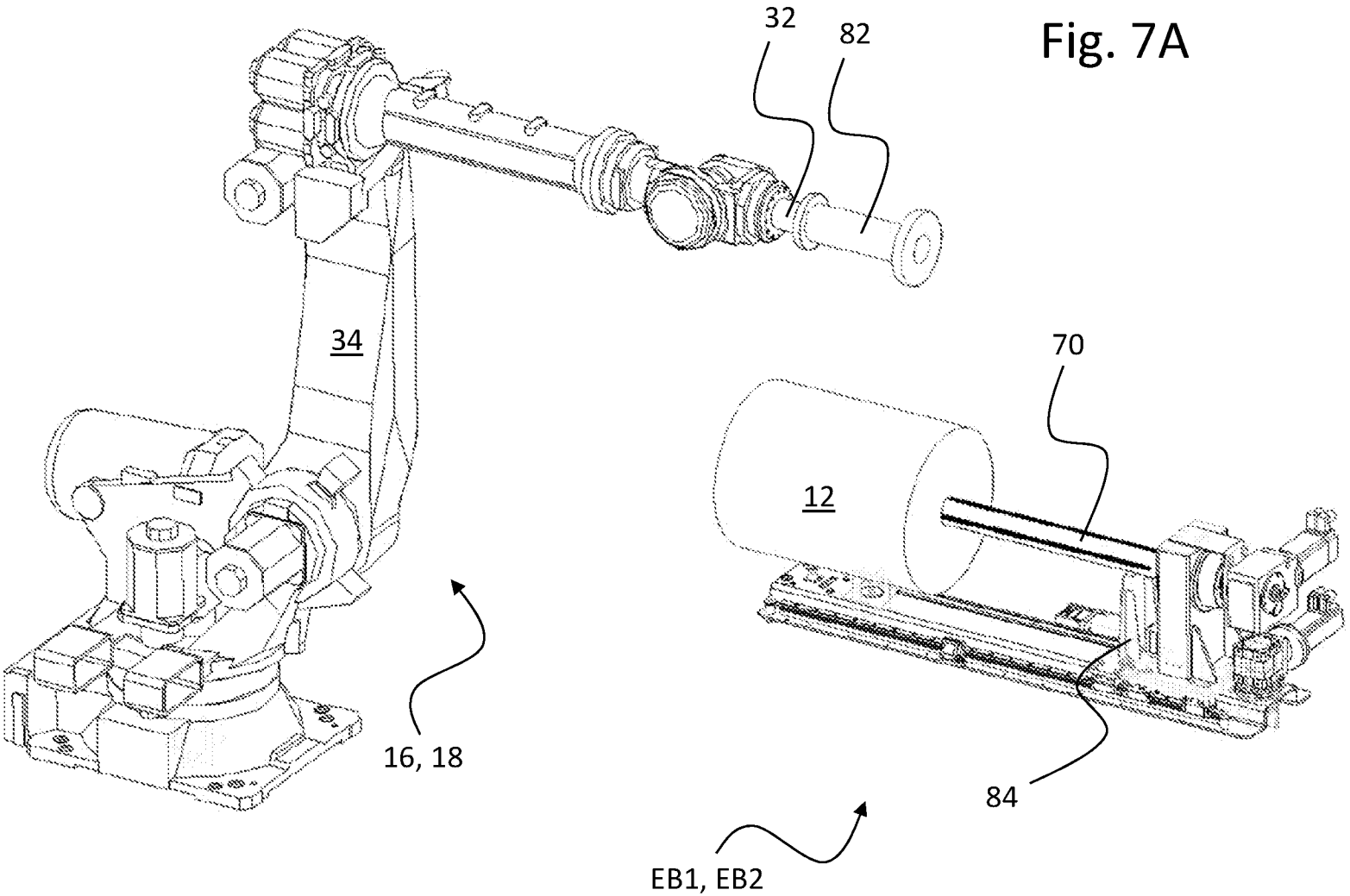
FIG. 7 shows a handling device, in two further perspective views, in the process of mounting the new rolls into the packaging machine.
Figure 7B:
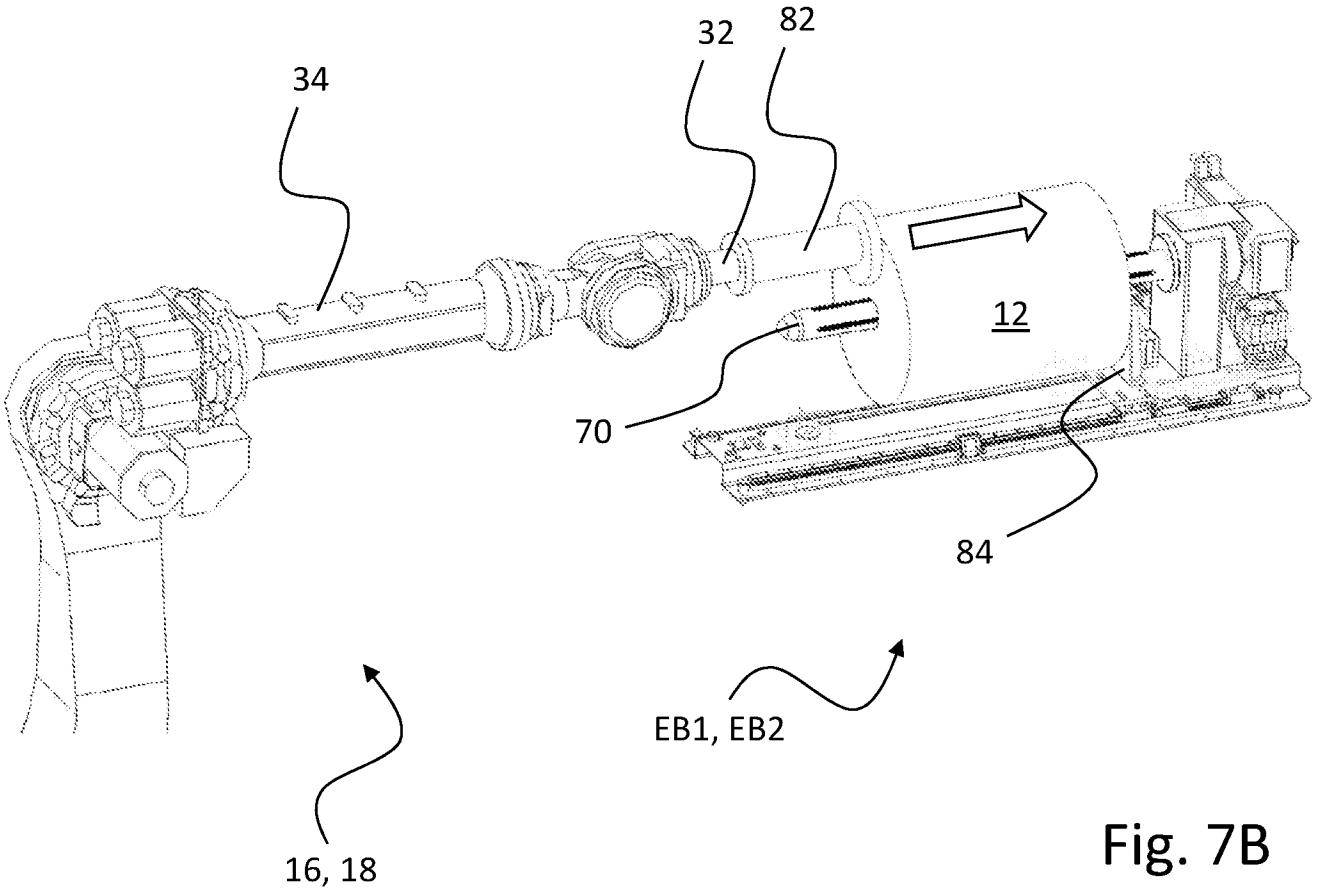

The two schematic perspective views of the FIGS. 7A and 7B illustrate the positioning process for a new roll 12 in one of the provided installation positions EB1 or EB2 in the packaging machine 14 (cf. FIGS. 3 to 5). The FIG. 7A thus shows a new roll 12 of packaging material, the roll having been previously separated from the retaining mandrel 32 of the handling robot 18 and already having been slid by a short distance onto a receiving mandrel 70 in the packaging machine 14. The retaining mandrel 32 has subsequently been provided with a punch attachment 82, which, for the purpose of sliding the roll 12 onto the receiving mandrel 70 against an axial stop 84, has been temporarily affixed to the retaining mandrel 32 of the handling robot 18. Illustrated in FIG. 7B is this sliding process, by which the punch attachment 82 presses against the front side of the roll 12 until the roll has been slid against the axial stop 84 and thus into its intended installation position EB1 or EB2. After reaching the installation position EB1 or EB2, the handling robot 18 can be disconnected from the roll 12 and can be applied to new tasks.

Sliding a used-up or almost depleted roll 20 off of the receiving mandrel 70 and taking over the roll by the retaining mandrel 32 of the handling robot 18 is, by contrast, facilitated by a shiftable axial stop 84 as well as by a shiftable bearing of the rotatable receiving mandrel 70, as is illustrated in the FIGS. 8A to 8D.

Figures 8A, 8B:
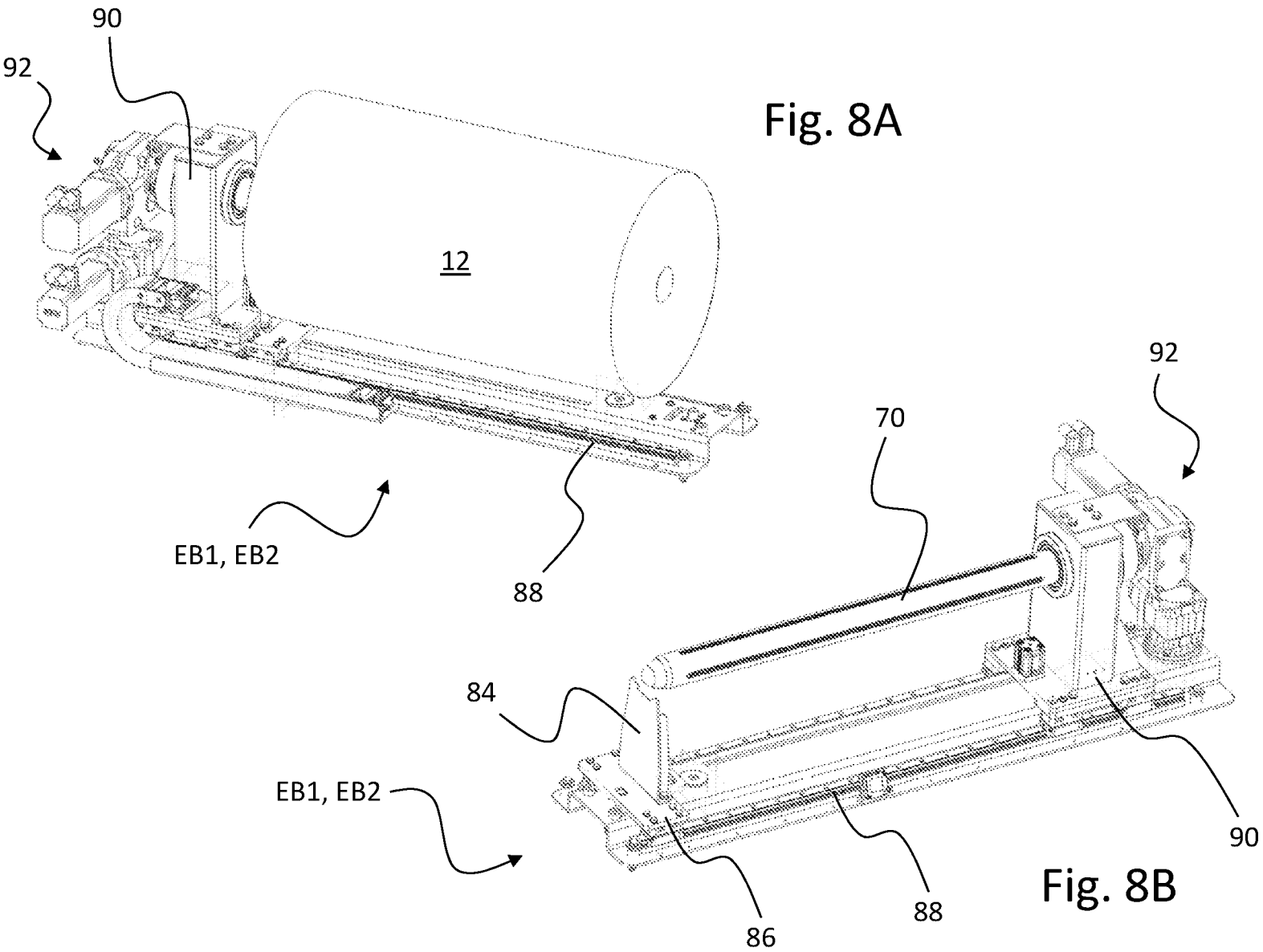
FIG. 8 shows four views of the positioning steps and removal steps when mounting or, as the case may be, removing a roll from an installation position within the packaging machine.

The two schematic perspective views of the FIGS. 8A and 8B illustrate the different operating states of a roll 12 located in the intended installation position EB1 or EB2 in the packaging machine 14 (cf. FIGS. 3 to 5) on the receiving mandrel 70 (FIG. 8A) or, as the case may be, of a roll having been removed from there (FIG. 8B). Whereas the roll 12 in the illustration of FIG. 8A is ready for unwinding in the provided installation position EB1 or EB2, as the case may be, it has been slid off of the receiving mandrel 70 in the illustration of FIG. 8B by shifting the axial stop 84, and has been taken over, for example, by the handling robot 18 (not shown). The slidable axial stop 84 is located on a base 86 that is movable parallel to the longitudinal extension direction of the receiving mandrel 70, the base 86 being held and being movable in two parallel longitudinal guides 88. In the instance of the roll 12 being arranged on the receiving mandrel 70, the base 86, being held and being horizontally shiftable in the longitudinal guides 88, with the axial stop 84, is inherently located close to a pedestal block 90 (FIG. 8A), which simultaneously forms the bearing and a drive 92 for the rotatingly driven receiving mandrel 70.

Figure 8C:
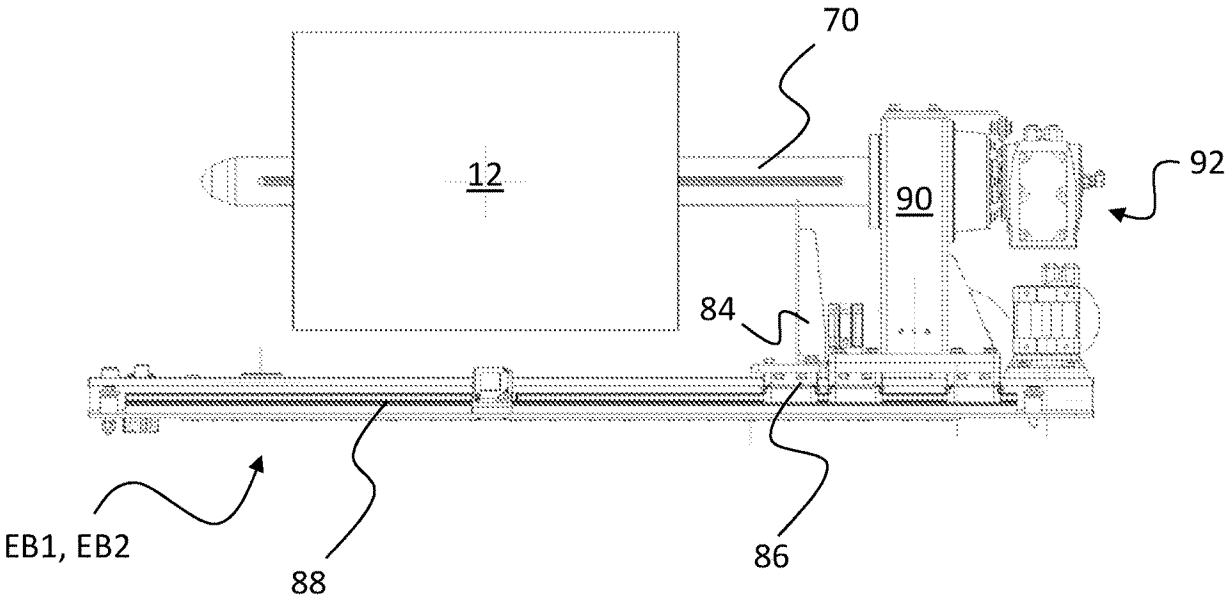
Figure 8D:
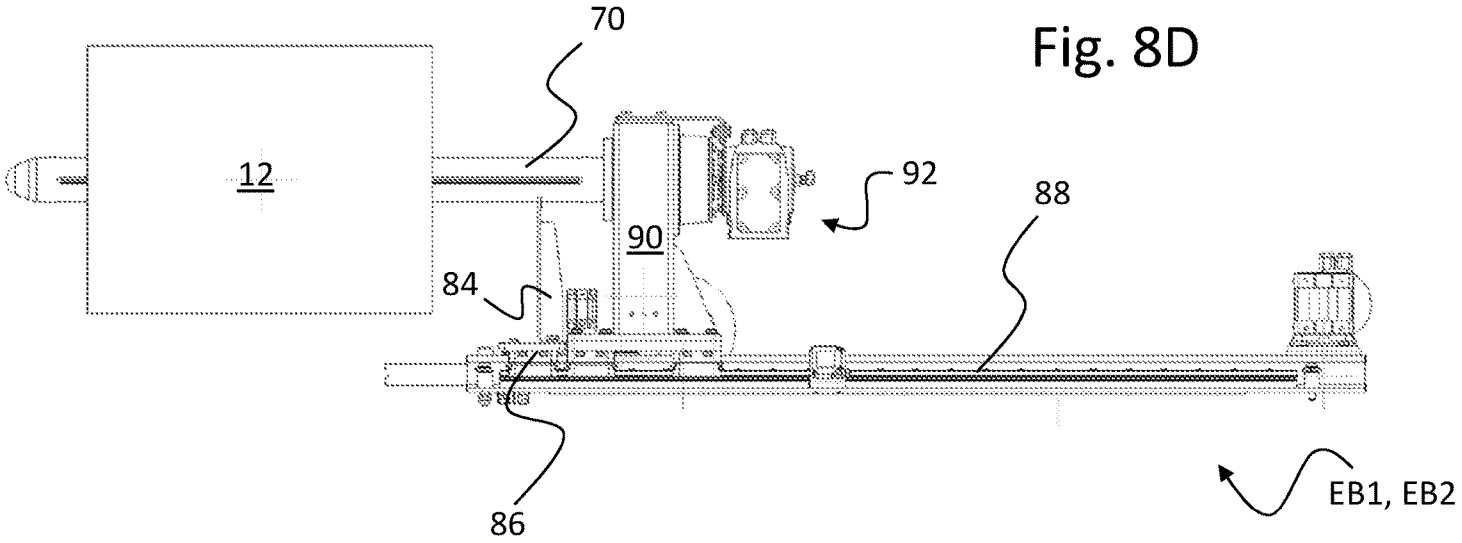

As made clear by the two schematic lateral views of FIGS. 8C and 8D, the entire pedestal block 90, together with its drive 92 and the rotatingly driven receiving mandrel 70, is preferably designed to be slidable along the two parallel horizontal guides 88, thus facilitating, pursuant to the method according to the invention, the process of fitting a new roll 12 onto the receiving mandrel 70 as well as facilitating the removal of a used-up roll by the handling robot 18.

The FIG. 8C shows a roll 12 positioned on the receiving mandrel 70. The pedestal block 90 with the drive 92 is in this context located at a right-hand stop, where the roll 12 that is ready for unwinding is located in the packaging machine 14. The axial stop 84 has moved with its base 86 against the pedestal block 90 such that the stop 84 is in no touching contact with the roll 12. The FIG. 8D likewise shows the roll 12 positioned on the receiving mandrel 70. The pedestal block 90 with the drive 92 has in this context been shifted to the left, as has the axial stop 84, which abuts with its base 86 on the pedestal block 90 and has thus been likewise moved to the left. The receiving mandrel 70 that is rotatably mounted at the pedestal block 70 together with the roll 12 located thereon is in this context moved by a distance out of the installation position EB1 or EB2, as the case may be, such that the roll 12 is in no position that is suitable for unwinding, but rather in a position for being removed or fitted, in which position it can be easily taken over from the handling robot 18 or passed on to the packaging machine 14. In particular the position shown in FIG. 8D can form the starting position for sliding the roll 12 off of the receiving mandrel 70 when the pedestal block 90 with the mandrel 70 is moved to the right into the original operating position (corresponding to FIG. 8C) while the base 86 with the axial stop 84 remains in its location (corresponding to FIG. 8D). In this context, the mandrel 70 moves out from the roll core 26 while the axial stop 84 abuts face-side on the roll 12 and holds it in place. The retaining mandrel 32 of the handling robot 18 can then be inserted into the now vacant roll core 26 and finally take over and extract the roll 12 from the receiving mandrel 70.

It should be additionally noted that the receiving mandrel 70 can be adjustable in axial direction for the purpose of aligning and centrally positioning as accurately as possible a newly mounted roll 12 in relation to the packaging material to be unwound from the roll 12, this being enabled by correspondingly shifting the pedestal block 90 by the drive 92. In this way, the axial shiftability of the receiving mandrels 70 defined in the context of the facilitated mounting of new rolls 12 into the packaging machine 14 can additionally be used for positioning the newly mounted rolls 12 in each case accurately centrally in relation to the material web to be unwound. It is thus not in each case mandatorily required to slide the roll 12 onto the receiving mandrel 70 by a precisely defined distance, since said mandrel 70 itself can provide for the precision adjustment after the roll has been slid on in an approximately fitting way in order to convey the material web in an accurately fitting alignment into the packaging machine 14.

The receiving mandrel 70 can optionally also be repeatedly readjusted in its axial position during the ongoing operation of unwinding the packaging material from the roll 12, in particular in order to compensate for winding inaccuracies and/or for position changes of the packaging material during a packaging operation. This readjustability can be monitored and initiated, for example, by cameras or suitable optical sensor devices. The shiftability or, as the case may be, the readjustability of the receiving mandrel 70 can be brought about, for example, by a pneumatic, hydraulic, or electromotive drive 92.

The FIG. 9 shows in a total of six schematic lateral views (FIGS. 9A to 9F) the method procedures involved in the process of mounting a new roll 12 with flat material or film material into a packaging machine 14, into one of the installation positions EB1 or, as the case may be, EB2. The gripping device and/or handling device 16 or, as the case may be, the handling robot 18 supplies a new roll 12 that is slid centered onto the retaining mandrel 32 to the packaging machine 14 in order to be able to slide it there onto the particular receiving mandrel 70 of the installation position EB1 or EB2 (FIG. 9A). The retaining mandrel 32 dips completely into the core 26 of the new roll 12 and extends to about a third of the entire length of the core 26 and therefore also a third of the width of the roll 12, thus making it possible to slide the roll 12 to two thirds of its width onto the receiving mandrel 70. While the handling robot 18 approaches the packaging machine 14 (FIG. 9A), the pedestal block 90, together with the receiving mandrel 70 mounted rotatably thereon, moves along the longitudinal guide 88 to the left toward the roll 12 (cf. FIG. 9B), the core 26 of which is already accurately aligned with the receiving mandrel 70, whereby the handling robot 18 can, by further moving to the right, slide the roll 12 to about two thirds of its width onto the receiving mandrel 70 (cf. FIG. 9C).

The pedestal block 90 is still in its position extending to the left, and it remains there until the roll 12 has been completely slid onto the receiving mandrel 70. The sliding procedure is carried out by setting the retaining mandrel 32 of the handling robot 18 off-center and face-side to the end face of the roll 12 facing away from the receiving mandrel 70 (cf. FIG. 9D) and by sliding the roll 12 further to the right onto the receiving mandrel 70 until the opposite end face of the roll 12 facing toward the pedestal block 90 has reached the axial stop 84, which is disposed close to the pedestal block 90 (cf. FIG. 9E). As soon as this is the case, the roll 12 has reached the intended axial position on the receiving mandrel 70 such that the pedestal block 90, together with the receiving mandrel 70 and the roll positioned thereon, can be returned to the intended installation position EB1 or EB2, as the case may be, in the packaging machine 14 (cf. FIG. 9F), where the film material or, as the case may be, flat material can be extracted from the roll 12 and can be used for packaging objects, piece goods, etc. (not shown; cf. the FIGS. 3 to 5 in this context).

Figure 9A:
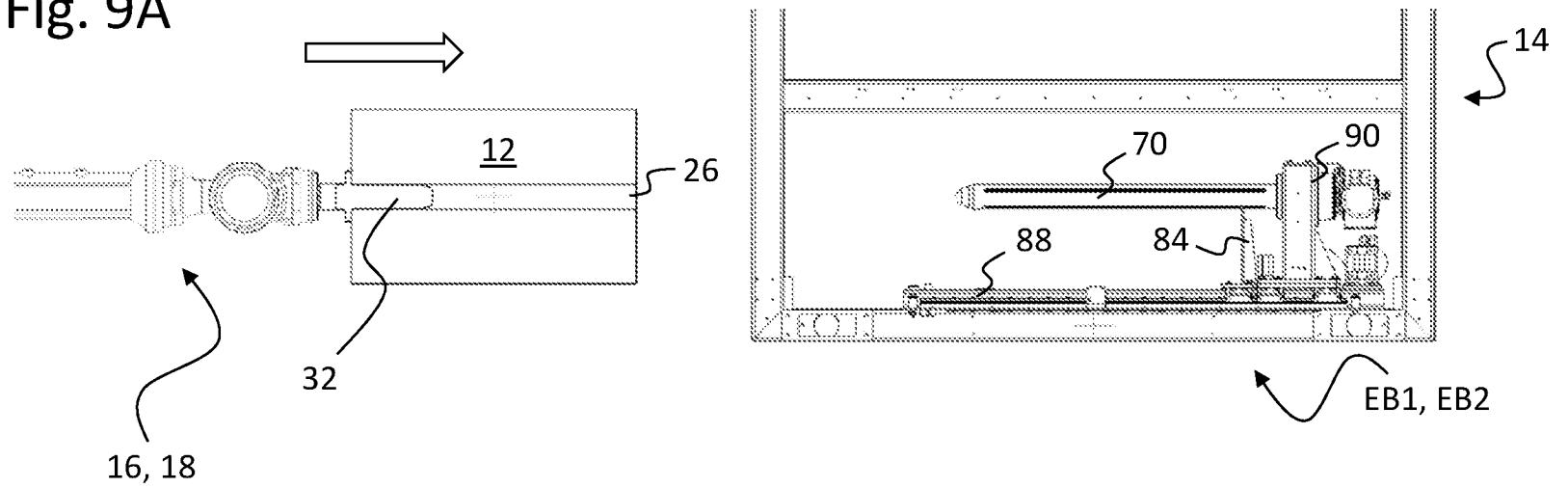
FIG. 9 shows in a total of six schematic lateral views the method procedures in the process of mounting a new roll with flat material or film material into a packaging machine.
Figure 9B:
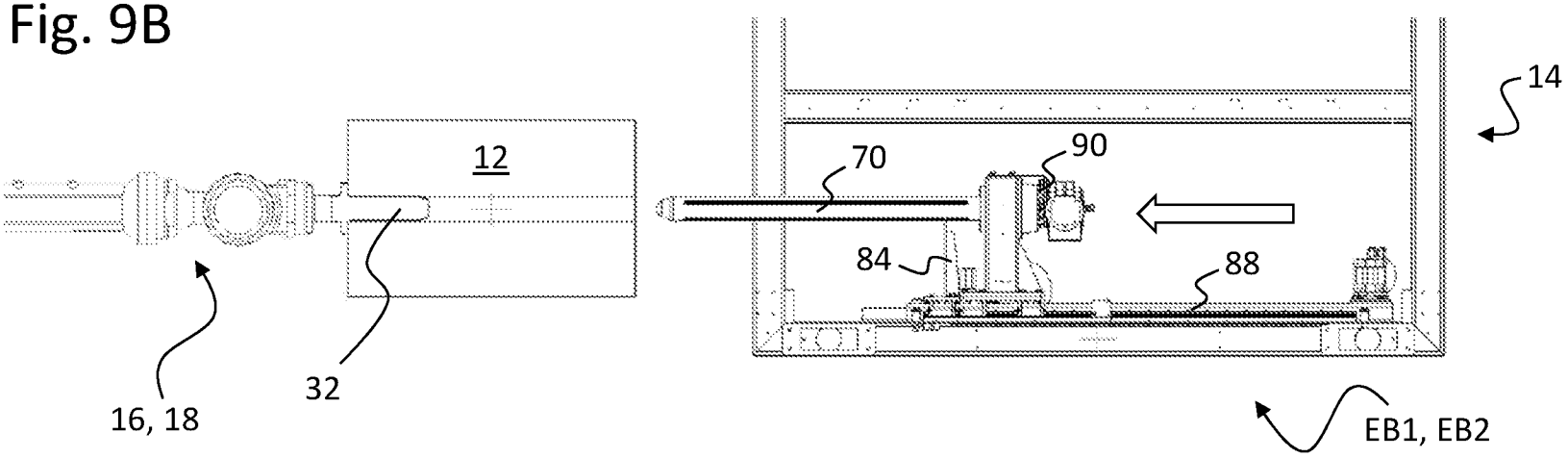
Figure 9C:
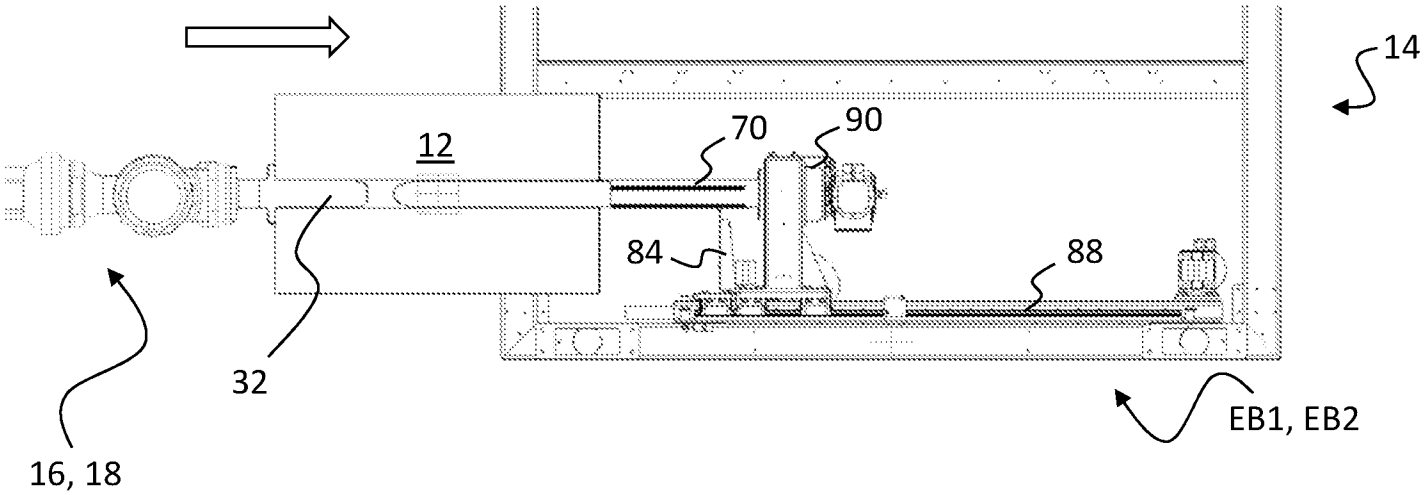
Figure 9D:
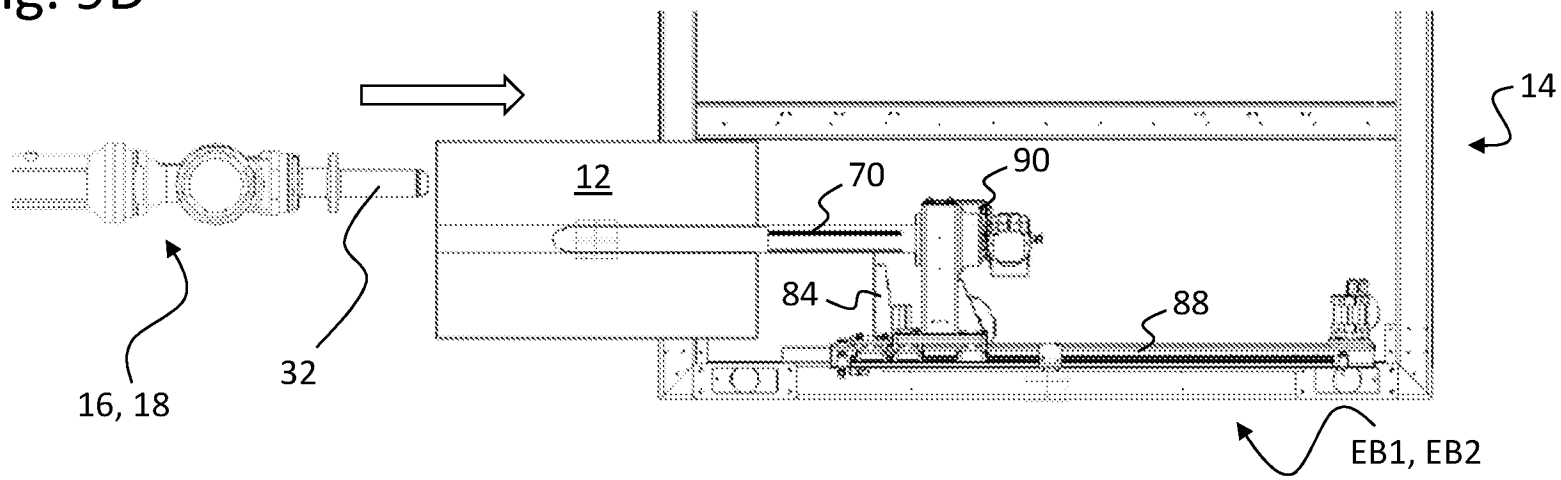

In principle, it would also be possible to let the receiving mandrel extend even further than shown in FIG. 9C, such that the handling device 16 would not have to perform any further stroke toward the mandrel. Normally, however, the range of movement of the gripping device and/or handling device 16 or, as the case may be, of the handling robot 18 is sufficient for positioning the rolls 12 onto the receiving mandrel 70 in the manner shown. The special advantage of the method shown and of the apparatus according to FIG. 9 lies in the robot 18 completely leaving the operating range and being able to prepare for the next rolls 12. This means that a further manipulator is not needed for receiving the rolls 12 and can be saved for use in the buffer system.

Figure 9E:
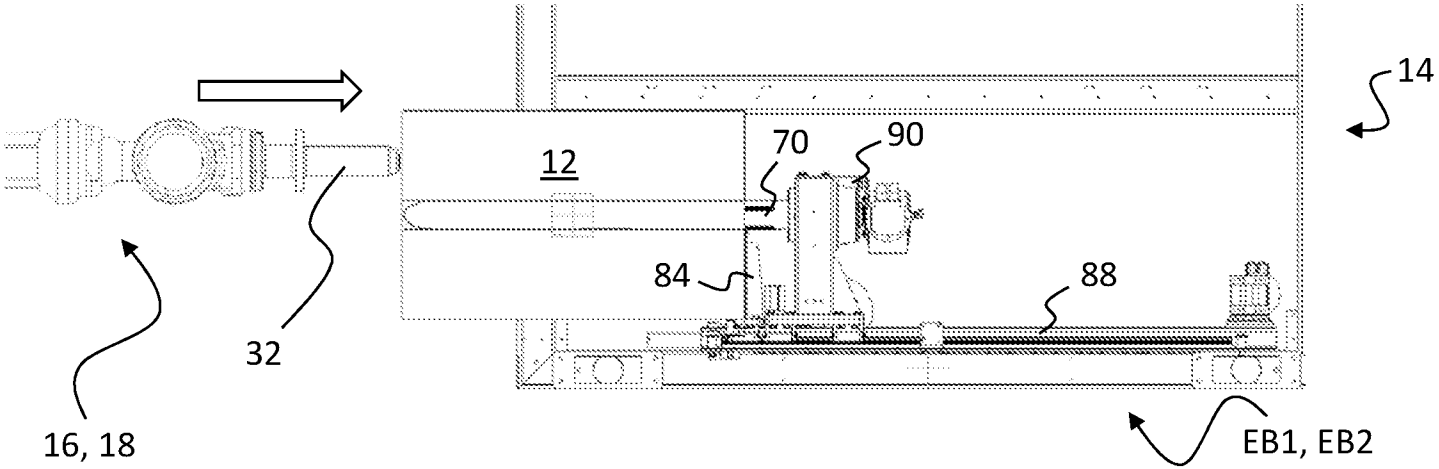
Figure 9F:
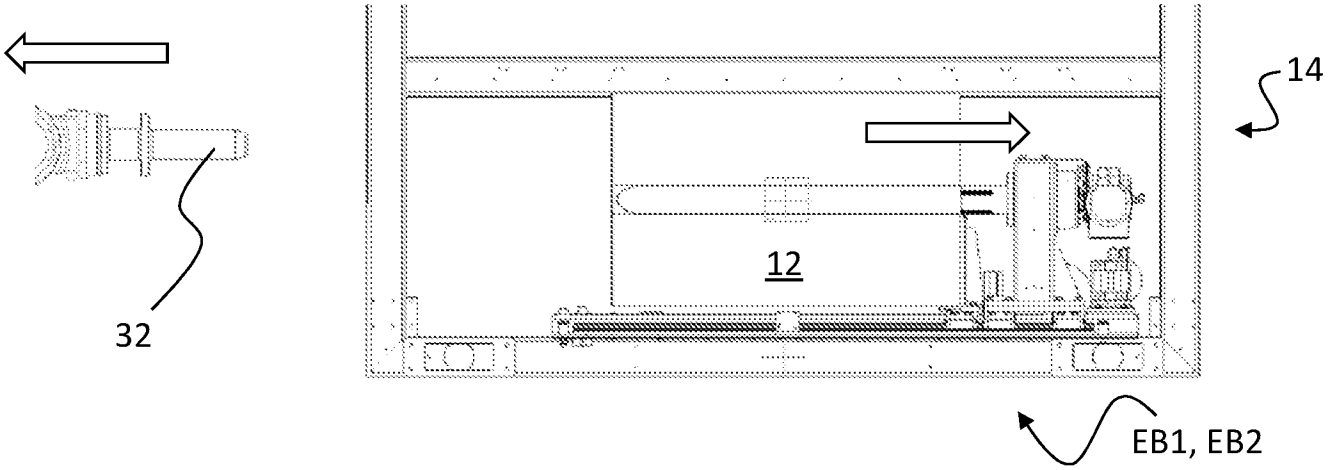

It does not need to be explicitly mentioned here that the roll 12 is clamped onto the retaining mandrel 32 with its roll core 26 for as long as it should be fixed there (FIG. 9A, FIG. 9B, FIG. 9C). This clamping is then opened for releasing the core 26 when the roll 12 has been slid onto the mandrel 70 (FIG. 9C). Only after sliding the roll 12 completely onto the receiving mandrel 70 is the roll core 26 fixedly clamped there (FIG. 9E, FIG. 9F).

The FIG. 10 shows in a total of six schematic lateral views (FIGS. 10A to 10F) the method procedures involved in the process of dispensing a used-up roll 20 from the packaging machine 14, from one of the installation positions EB1 or, as the case may be, EB2. The roll 20 to be replaced that is located on the receiving mandrel 70 is shifted to the left by shifting the pedestal block 90 on the longitudinal guides 88 (cf. FIG. 10A) toward the gripping device and/or handling device (not yet discernible here). As soon as the pedestal block 90 has reached the left stop, the axial stop 84, which is likewise slidably guided on the longitudinal guides 88, remains in its very left position while the pedestal block 90 moves to the right away from the axial stop 84, such that said stop 84 slips or, as the case may be, slides the roll 20 to the left off of the receiving mandrel 70 (cf. FIG. 10B). The pedestal block 90 with the receiving mandrel 70 rotatably mounted thereon is shifted further to the right toward the installation position EB1 or EB2, as the case may be, while the axial stop 84 with the roll 20 held thereat remains in the left stop position (cf. FIG. 10C).

Only when the receiving mandrel 70 has been extracted about halfway out of the roll core 26 (FIG. 10C), the retaining mandrel 32 of the handling robot 18 dips into there (cf. FIG. 10D) and is clamped in the core 26 in order to subsequently be able to extract the roll 20 from the receiving mandrel 70. The process of extracting is discernible in FIG. 10E. The used-up roll 20 can subsequently be disposed of. The FIG. 10F shows the pedestal block 90 being moved, after extraction of the roll 20, together with the receiving mandrel 70 rotatably mounted thereon to the very left up to the axial stop 84 still located there (cf. FIG. 10E), thus forming a position ready for taking over a new roll 12 (cf. FIGS. 9B and 9C)

Figure 10A:
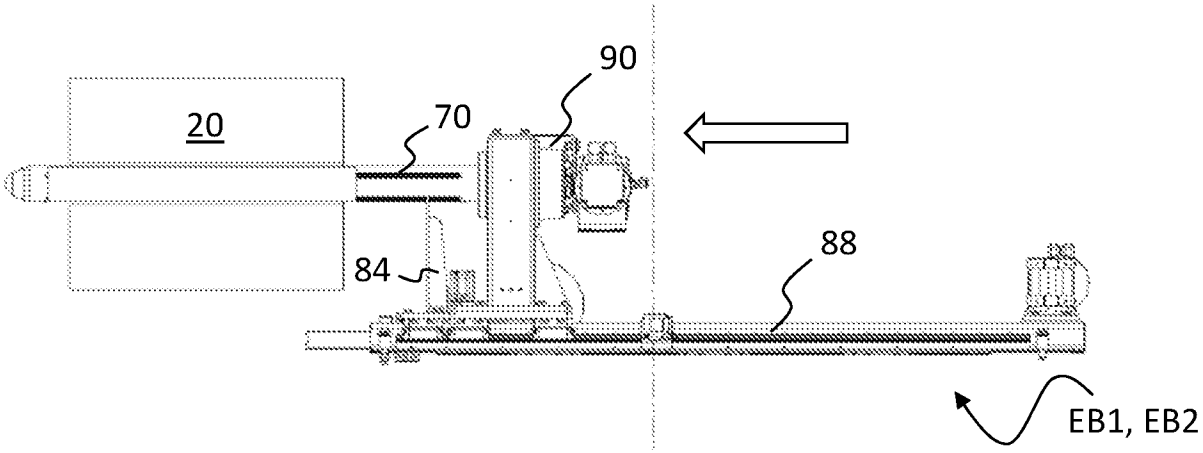
FIG. 10 shows in a total of six schematic lateral views the method procedures in the process of dispensing a used-up roll from the packaging machine.
Figure 10B:
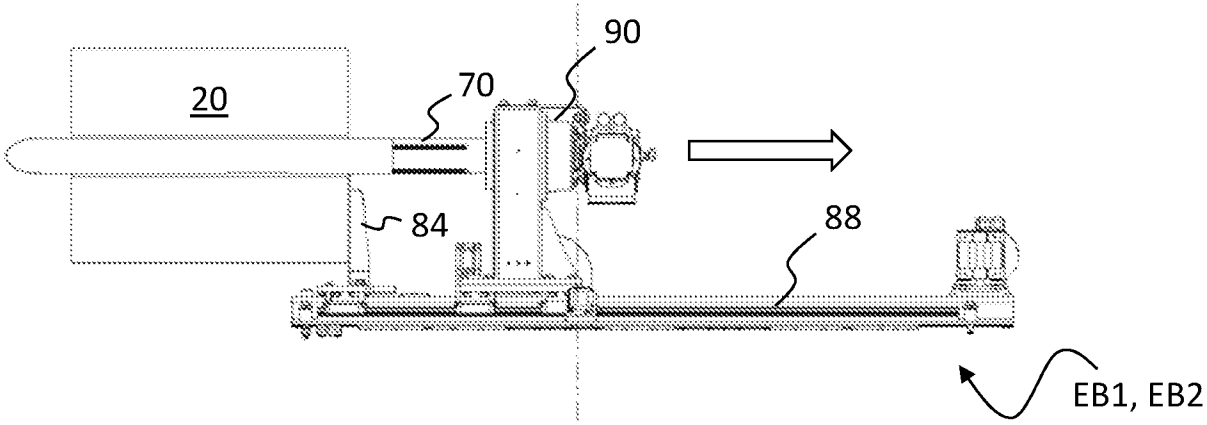
Figure 10C:
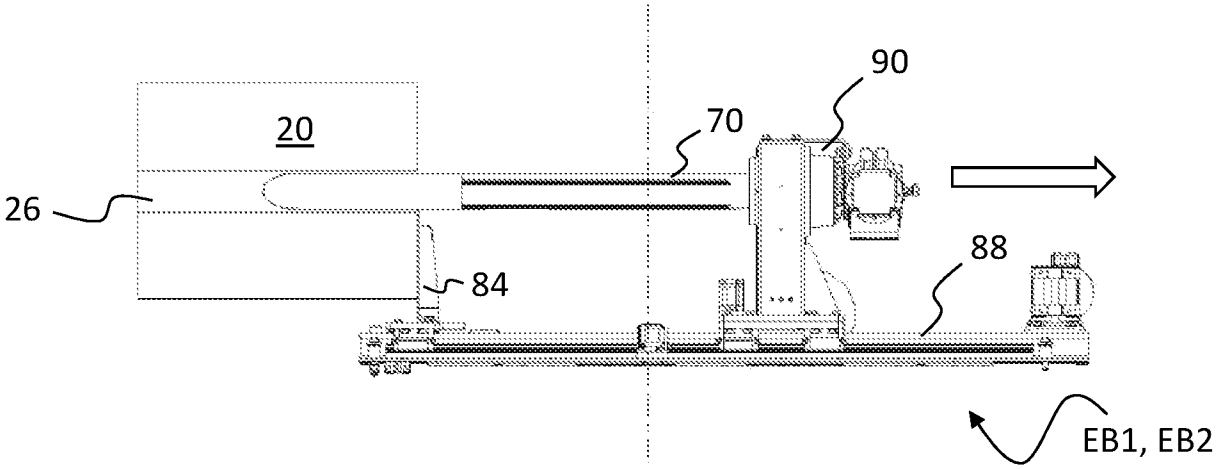
Figure 10D:
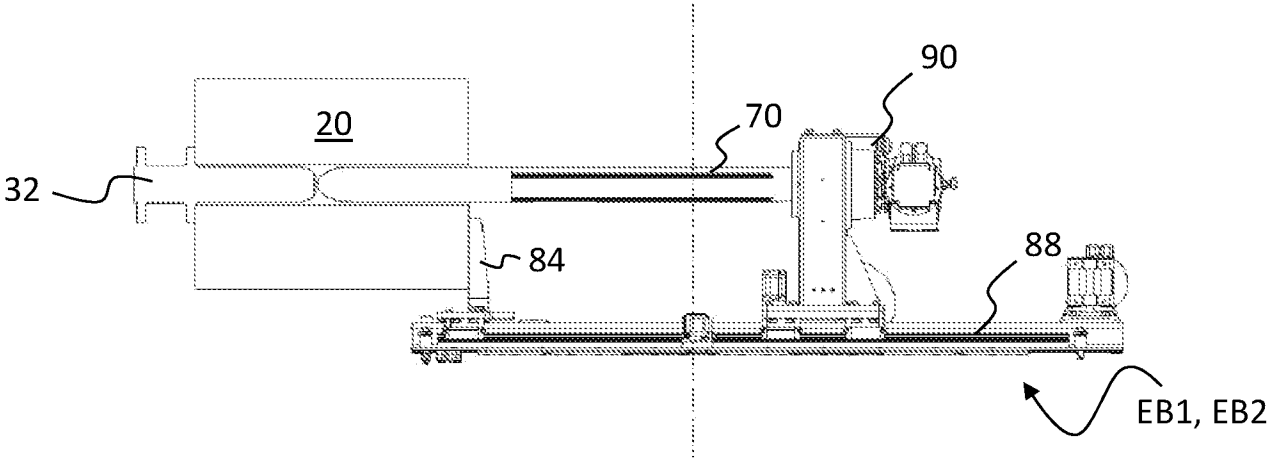
Figure 10E:
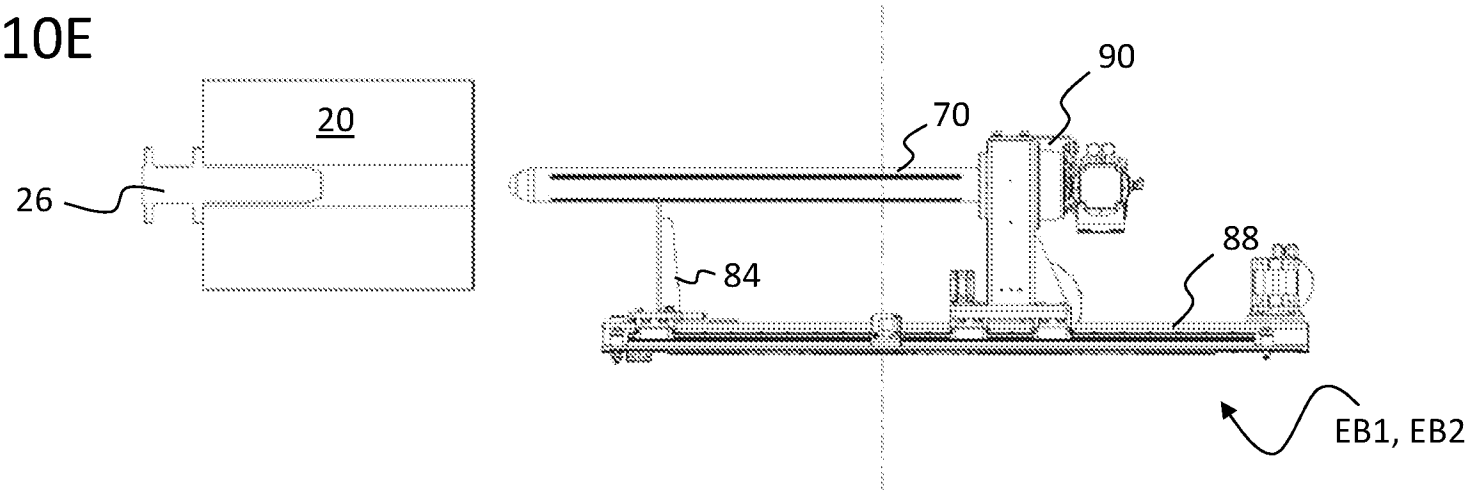
Figure 10F:
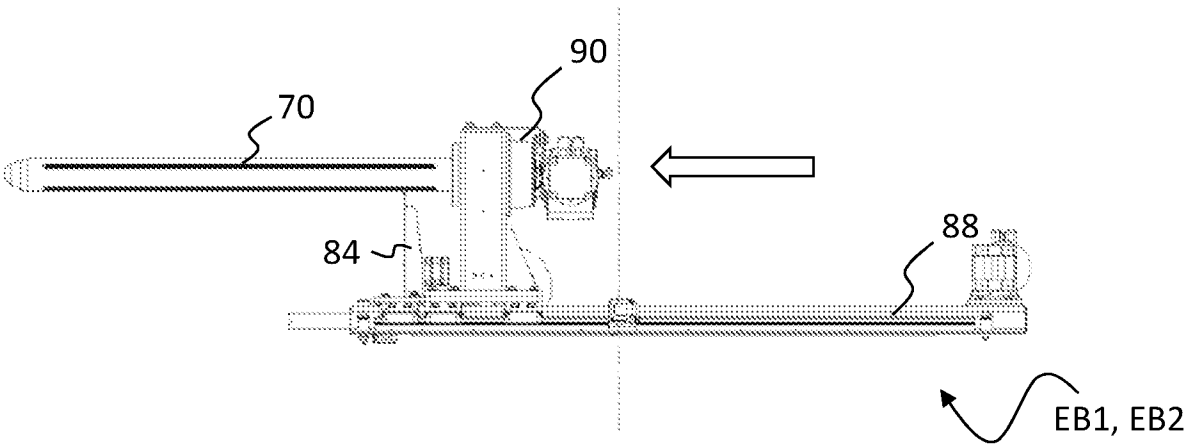

It does not need to be explicitly mentioned here that the roll 20 is clamped onto the receiving mandrel 70 with its roll core 26 for as long as it should be fixed there (FIG. 10A). This clamping is then opened for releasing the core 26 when the roll 20 is to be shifted in relation to the mandrel 70, as is the case in the FIGS. 10B and 10C. The retaining mandrel 32 of the handling robot 18 is also first inserted loosely into the core 26 (cf. FIG. 10D) before it is clamped into the roll 20 for taking over the roll 20 and the roll 20 is thus fixedly fastened (FIG. 10E).

The FIG. 11 shows in a total of six schematic lateral views (FIG. 11A to FIG. 11F) the accurate axial aligning of a new roll 12 on a receiving mandrel 70 for the accurate positioning of the roll 12 into one of the installation positions EB1 or EB2, as the case may be, in the packaging machine 14. The FIG. 11A illustrates the receiving mandrel 70 appropriately positioned in relation to the machine center (dotted vertical line), on which receiving mandrel 70 the roll 12 is intended to be positioned likewise centrally so that it assumes its optimal position for a smooth unwinding of the material web.

Figure 11A:
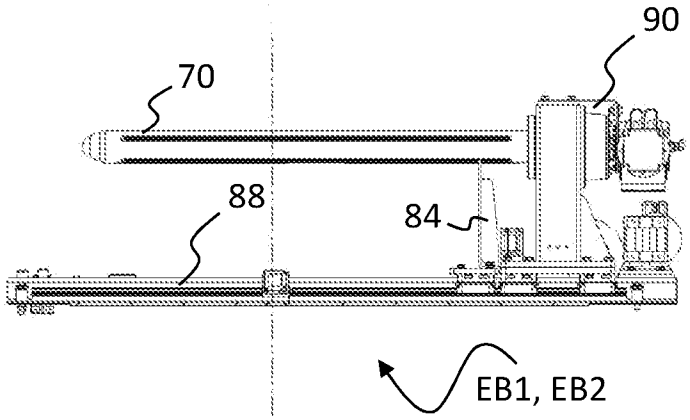
FIG. 11 shows in a total of six schematic lateral views the accurate axial aligning of a new roll on a receiving mandrel for the accurate positioning in the packaging machine.
Figure 11A:
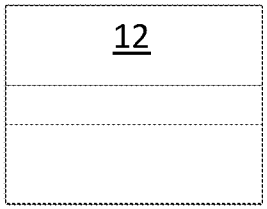
Figure 11B:
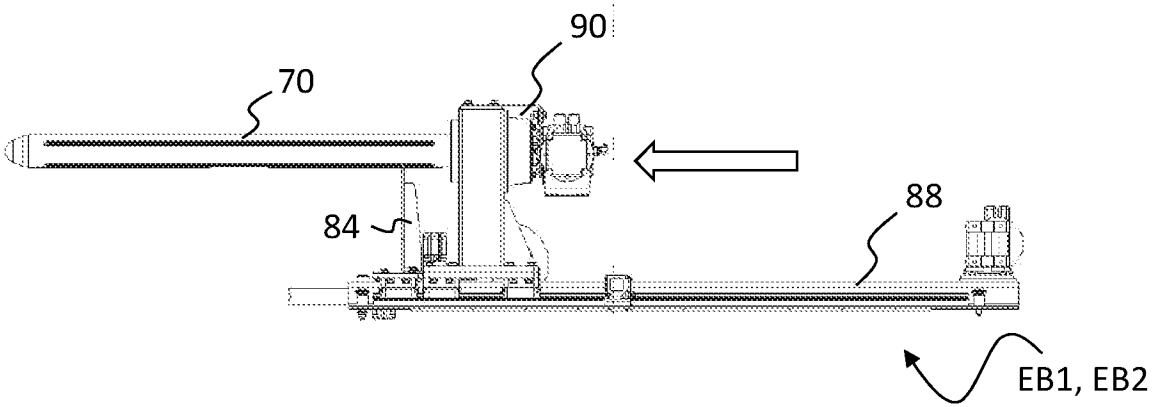
Figure 11B:
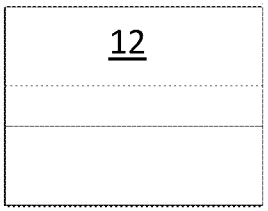
Figure 11C:
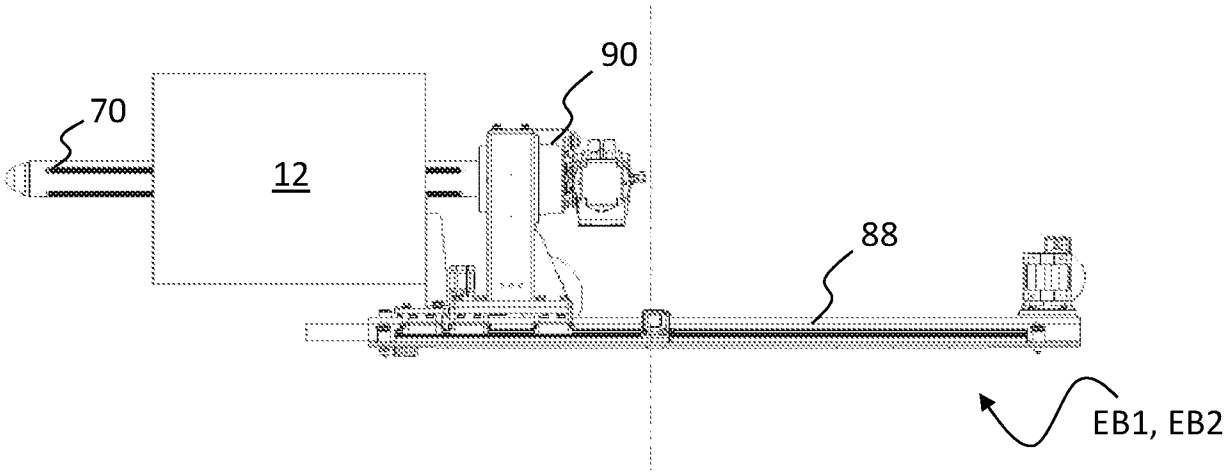
Figure 11D:
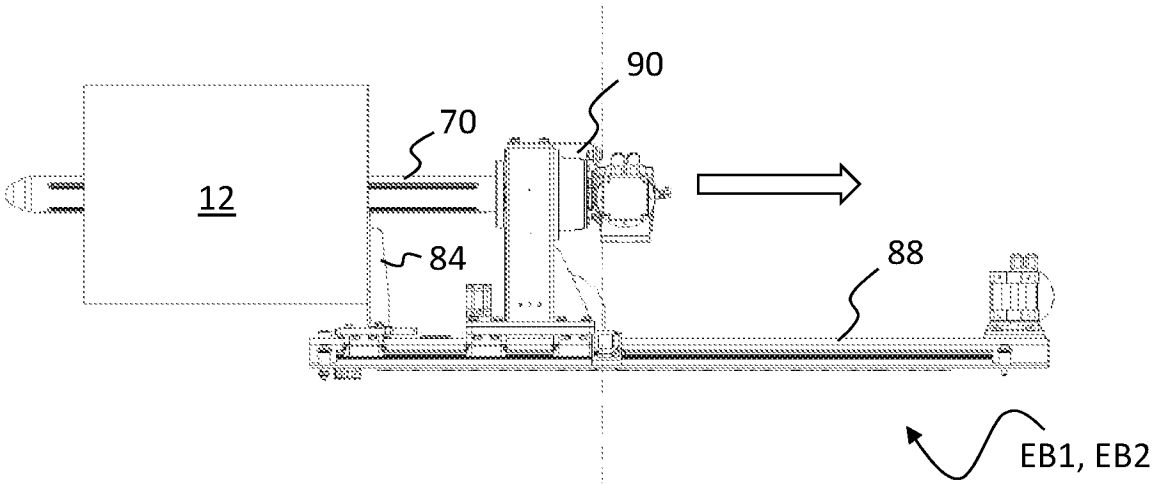
Figure 11E:
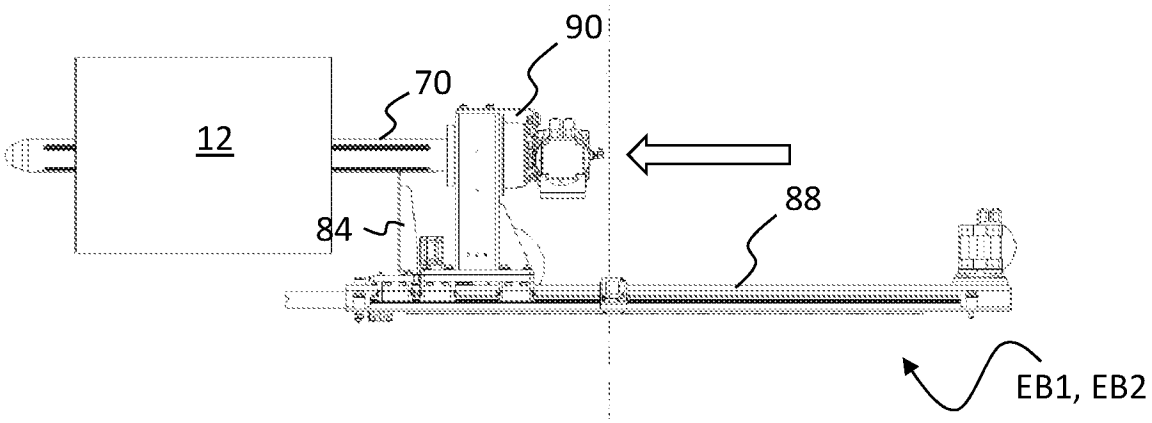
Figure 11F:
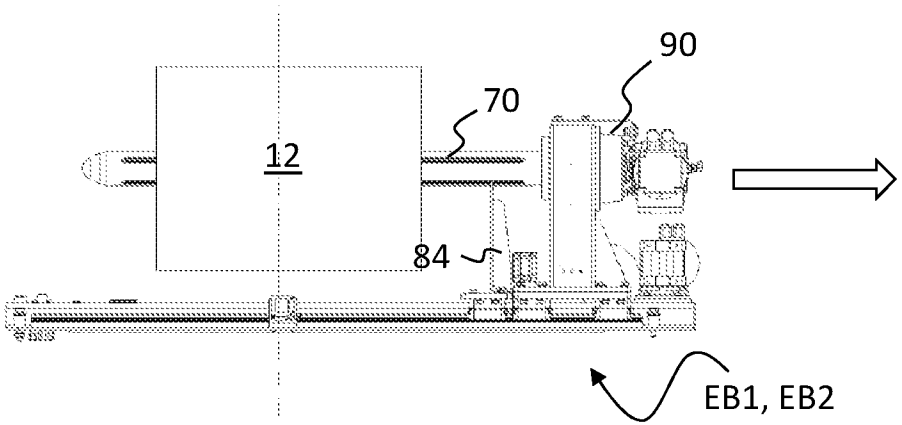

The pedestal block 90 is moved together with the receiving mandrel 70 as well as the axial stop 84 to the left along the guide rails 88 for taking over a new roll 12 (cf. FIG. 11B). When the roll 12 has been completely slid onto the receiving mandrel 70 (cf. in this context the FIG. 9E), it is possible that it is placed on the receiving mandrel 70 in an axial position that is not optimal; for example, the roll 12 can have been slid onto the mandrel 70 a bit too far, as is shown in FIG. 11C. This inappropriate positioning can be corrected by retracting the pedestal block 90 to the right while the axial stop 84 remains stationary, such that the receiving mandrel 70 is likewise shifted by a defined distance in relation to the roll 12 that is fixed by the stop 84 (cf. FIG. 11D). As soon as the desired adjustment of the roll 12 on the receiving mandrel 70 has been reached, said receiving mandrel 70 is shifted back to the left by shifting the pedestal block 90 toward the axial stop 84 (cf. FIG. 11E), whereby the roll 12 is moved away from the axial stop 84. By shifting the pedestal block 90 together with the axial stop 84 abutting on it to the right into the installation position EB1 or EB2, as the case may be, the roll 12 is brought into an accurately appropriate alignment with the machine center (dotted vertical line) corresponding to the desired final installation position EB1 or EB2, as the case may be, from where the rolls 12 in the packaging machine 14 can be unwound.

In particular with reference to the FIG. 7 *ff*, it should be noted once more in this context that the shown gripping device and/or handling device 16 or, as the case may be, the shown handling robot 18 is not strictly required for mounting and removing new rolls 12. Replacing the rolls 12 or, as the case may be, the rolls 20 is also possible in a corresponding manner by an interaction of the axially movable receiving mandrels 70 and the horizontal conveying device 28, which supplies new rolls 12 and reaches up to the packaging machine 14, or also by interaction of the receiving mandrels 70 with AGVs, which can move directly up to the packaging machine 14 as already indicated above.

The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

LIST OF REFERENCE CHARACTERS

10 Device
12 Roll, new roll
14 Packaging machine
16 Gripping device, handling device, gripping device and/or handling device
18 Multi-axis robot, handling robot
20 Roll, depleted roll, partly unwound roll, partly depleted roll, empty roll
22 Material web, packaging material
24 Outer layer, outer material web
26 Core, roll core
28 Horizontal conveying device
30 Cantilever arm, swivel arm
32 Retaining mandrel
34 Arm section, gripping arm
36 Axis of rotation, horizontally oriented axis
38 Control unit
40 Output signals, signals, room data, movement data, sensor data
42 Room monitoring device
44 Optical detection device, camera
46 Range of movement, movement range
48 Manipulator
50 User, operator
52 Pallet
54 Retaining mandrel
56 Container
58 Display device
60 Intermediate deposit
70 Mandrel, receiving mandrel, retaining mandrel
72 Sealing bar
74 Camera
76 Adhesive label, optically identifiable/reflective adhesive label
78 Gripping rod
80 Camera, further camera (of the handling robot)
82 Punch attachment
84 Axial stop
86 Slidable base
88 Longitudinal guide, parallel longitudinal guides
90 Pedestal block
92 Drive
EB1 First installation position
EB2 Second installation position

The invention claimed is:

1. A method for supplying, staging, and/or handling, and/or for replacing rolls (12, 20) of packaging material (22) for packaging piece goods, bundles, or sets of articles, comprising:

staging one or more new rolls (12), in a feeder device, to a packaging machine (14);

removing approximately completely unwound and/or a depleted roll (20) from one of the installation positions (EB1, EB2) of the packaging machine (14), mounting one a single new roll (12), into the particular installation position (EB1, EB2) after a depleted roll (20) was previously removed from there, wherein each of the installation positions (EB1, EB2) in the packaging machine (14) comprise at least one rotatable receiving mandrel (70) for the rotatable reception and holding of the rolls (12) of packaging material (22), and wherein the removing step comprises shifting the depleted roll (20) by moving the at least one rotatable receiving mandrel (70) an axial direction and/or the mounting step comprises shifting the new roll (12) by moving the at least one rotatable receiving mandrel (70) in an axial direction.

2. The method of claim 1, further comprising conveying new rolls (12) directly up to the packaging machine (14).

3. The method of claim 1, wherein each of the at least one receiving mandrel (70) is axially moved by a motor.

4. The method of claim 3, wherein the at least one receiving mandrel (70) is moved in coordination with moving of a gripping device and/or handling device (16).

5. The method of claim 4, wherein the gripping device and/or handling device (16) comprises a multi-axis robot (18) that receives new rolls (12) from the specified feeding means and places them in the packaging machine (14).

6. The method of claim 5, wherein, during mounting a new roll (12) into the packaging machine (14), the roll (12) is passed on to the at least one receiving mandrel (70), which has been shifted in its axial direction, and slid onto the receiving mandrel (70) by feeder device and the gripping device and/or handling device (16) associated with feeder device, whereupon the receiving mandrel (70) is moved in axial direction into a position intended for unwinding the roll (12).

7. The method of claim 6, wherein, during mounting a new roll (12) into the packaging machine (14), the roll (12) is passed on to the at least one receiving mandrel (70), which has been shifted in its axial direction, and slid onto the receiving mandrel (70) by the gripping device and/or handling device (16), whereupon the receiving mandrel (70) is moved in axial direction into a position intended for unwinding the roll (12).

8. The method of claim 7, wherein, during removing an approximately completely unwound and/or depleted roll (20), the receiving mandrel (70) is moved in axial direction and the roll (20) is passed on to the gripping device and/or handling device (16) by a stop element (84), which is movable in a direction parallel to the receiving mandrel (70), sliding the roll (20) at least partly off of the receiving mandrel (70) and onto a retaining mandrel (32) of the gripping device and/or handling device (16), whereupon the receiving mandrel (70) is returned in axial direction at least so far that the roll (20) is almost completely or completely slipped off.

9. The method of claim 8, further comprising verifying a rotation-direction-conforming position of each roll (12) that is to be newly mounted into the packaging machine (14) and correcting, if required, while the roll (12) is being handled by a gripping device and/or handling device (16).

10. An apparatus (10) for supplying, staging, and/or handling, and/or for replacing rolls (12, 20) with flat material or film material wound thereonto and serving as packaging material (22) for packaging piece goods, bundles, or sets of articles, comprising:

a packaging machine (14) with at least two installation positions (EB1, EB2), where at least approximately completely unwound and/or depleted rolls (20) are removable from at least one of the installation positions (EB1, EB2) and replaceable by new rolls (12) of flat material and/or film material at each of the at least two installation positions (EB1, EB2);

a feeder devices for staging new rolls (12) for the packaging machine (14) and for taking over the rolls (12) from the feeder device and for mounting the new rolls (12) into one of the at least two installation positions (EB1, EB2) and/or for removing depleted rolls (20) from the at least two installation positions (EB1, EB2), wherein the at least two installation positions (EB1, EB2) comprise at least one rotatable receiving mandrel (70) for the rotatable reception and holding of the particular roll (12), and wherein the at least one rotatable receiving mandrel (70) is shiftable in an axial direction and in the process is movable toward the feeder device for the purpose of removing an at least approximately completely unwound and/or depleted roll (20) and/or upon mounting of a new roll (12).

11. The apparatus of claim 10, wherein the at least one rotatable receiving mandrel (70) comprises a motor drive for the axial shifting of the at least one receiving mandrel (70).

12. The apparatus of claim 11, wherein the at least one receiving mandrel (70) comprises at least one shiftable axial stop element (84), wherein the at least one shiftable axial stop is shiftable by motor with the at least one receiving mandrel (70) or opposite to its axial direction of movement in parallel to said receiving mandrel (70).

13. The apparatus of claim 12, further comprising a gripping device and/or handling device (16) designed for mounting rolls (12) into one of the at least two installation positions (EB1, EB2), wherein the gripping device and/or handling device (16) comprises a multi-axis robot (18).

14. The apparatus of claim 13, wherein the multi-axis robot (18) comprising a retaining mandrel (32) having an enlargeable maximum cross-sectional diameter.

15. The apparatus of claim 13, wherein the gripping device and/or handling device (16) slides the roll (12) onto the receiving mandrel (70), wherein the receiving mandrel (70) is subsequently movable in axial direction into a position intended for unwinding the roll (12).

16. The apparatus of claim 15, wherein the at least one receiving mandrel (70) is movable in axial direction in order to pass on the roll (20) to the gripping device and/or handling device (16) by the stop element (84).

* * * * *